US007140944B2

(12) United States Patent
Harris

(10) Patent No.: US 7,140,944 B2
(45) Date of Patent: Nov. 28, 2006

(54) CONNECTING TOY

(75) Inventor: Peter M. Harris, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/040,113

(22) Filed: Jan. 24, 2005

(65) Prior Publication Data

US 2006/0166591 A1 Jul. 27, 2006

(51) Int. Cl.
*A63H 33/06* (2006.01)
*A63H 33/08* (2006.01)

(52) U.S. Cl. ..... 446/118; 446/120; 446/124

(58) Field of Classification Search ..... 446/85, 446/101, 102, 118, 120, 121, 124–126; 403/90
See application file for complete search history.

(56) References Cited

U.S. PATENT DOCUMENTS

| | | | | |
|---|---|---|---|---|
| D174,950 | S | 6/1955 | Frishberg | |
| 3,477,167 | A * | 11/1969 | Ach | 446/101 |
| 3,554,384 | A | 1/1971 | DeNatale | |
| 3,597,874 | A | 8/1971 | Ogsbury et al. | |
| 3,716,939 | A | 2/1973 | Pibet | |
| 3,747,261 | A | 7/1973 | Salem | |
| 4,306,373 | A | 12/1981 | Chatani et al. | |
| 4,516,364 | A | 5/1985 | Heider | |
| 4,582,495 | A | 4/1986 | Orgass et al. | |
| D285,592 | S | 9/1986 | Kushner | |
| 4,823,532 | A | 4/1989 | Westerburgen | |
| D309,639 | S | 7/1990 | Knudsen | |
| D311,936 | S | 11/1990 | Andersen | |
| 5,061,218 | A | 10/1991 | Garage et al. | |
| 5,064,399 | A * | 11/1991 | Klitsner et al. | 446/308 |
| 5,380,233 | A | 1/1995 | Numoto | |
| 5,645,464 | A * | 7/1997 | Chen | 446/120 |
| 5,661,941 | A | 9/1997 | Vataker | |
| D387,100 | S | 12/1997 | Nielsen et al. | |
| 5,743,779 | A | 4/1998 | Nielsen | |
| 5,769,681 | A * | 6/1998 | Greenwood et al. | 446/120 |
| 5,779,515 | A | 7/1998 | Chung | |
| 5,795,210 | A | 8/1998 | Kushner et al. | |
| D405,482 | S | 2/1999 | Nielsen | |
| 5,867,876 | A | 2/1999 | Petersen | |

(Continued)

FOREIGN PATENT DOCUMENTS

FR 2639556 A3 11/1989

(Continued)

*Primary Examiner*—Eugene Kim
*Assistant Examiner*—Alyssa M. Lowen
(74) *Attorney, Agent, or Firm*—Cooley Godward Kronish LLP

(57) ABSTRACT

A toy includes a base member and coupling member. In one embodiment, the base member has, for example, three attachment posts. The coupling member is configured to be removably coupled to any one of the attachment posts. The coupling member is also configured to be removably coupled among the three attachment posts. In one embodiment, the coupling member includes three projections that define a receiving portion. The receiving portion is configured to receive at least a portion of any one of the attachment posts. The projections of the coupling member are configured to be coupled among the three attachment posts. In another embodiment, the base member includes a prearranged play area that has a spherical portion, a cylindrical portion, and a wall portion. The coupling member is configured to be removably coupled to the spherical portion, the cylindrical portion, and the wall portion of the base member. In another embodiment, the coupling member includes an entertainment feature, such as, for example, a figure.

7 Claims, 27 Drawing Sheets

U.S. PATENT DOCUMENTS

| | | | | |
|---|---|---|---|---|
| 5,897,417 | A * | 4/1999 | Grey | 446/125 |
| D420,067 | S | 2/2000 | Nielsen | |
| D420,406 | S | 2/2000 | Stephensen | |
| 6,102,766 | A | 8/2000 | Leadbetter et al. | |
| 6,179,685 | B1 | 1/2001 | Toft | |
| 6,443,796 | B1 | 9/2002 | Shackelford | |
| 6,511,073 | B1 | 1/2003 | Simonds | |
| 6,572,429 | B1 * | 6/2003 | Cheung | 446/120 |
| 6,595,825 | B1 | 7/2003 | De Wilde | |
| 6,761,609 | B1 | 7/2004 | Andersen | |
| 2003/0036333 | A1 * | 2/2003 | Oakley | 446/85 |

FOREIGN PATENT DOCUMENTS

| | | | |
|---|---|---|---|
| GB | 2136700 | A | 9/1984 |

* cited by examiner

FIGURE 2
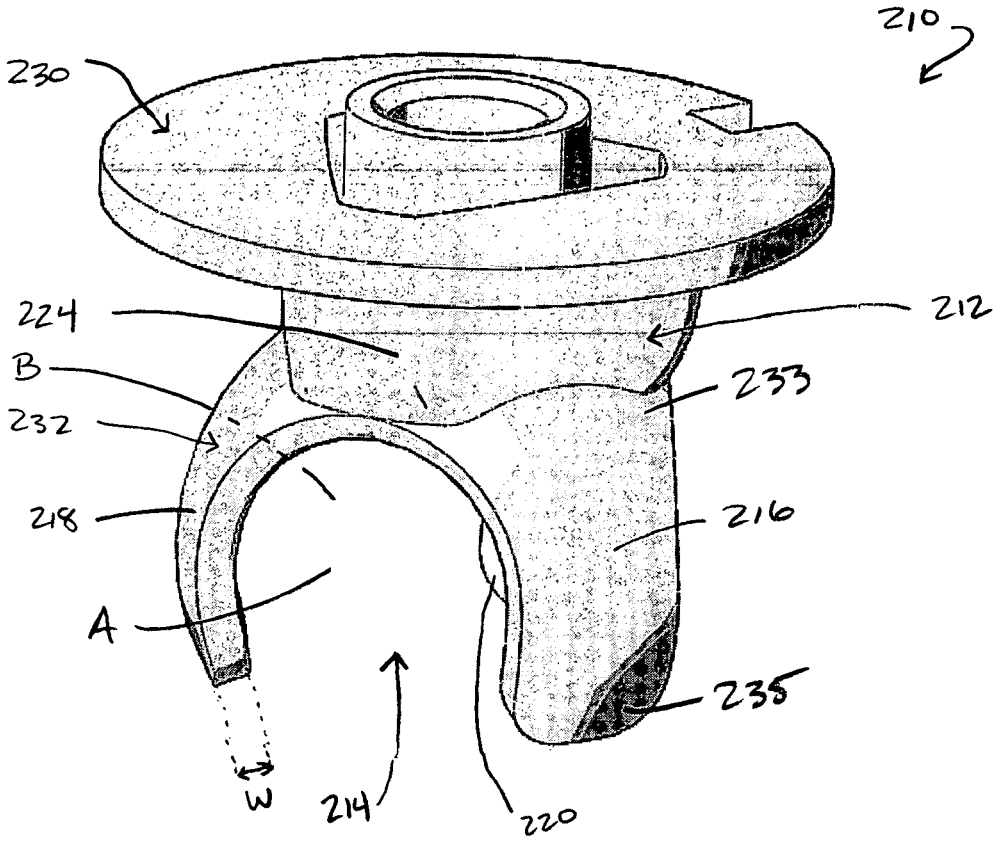
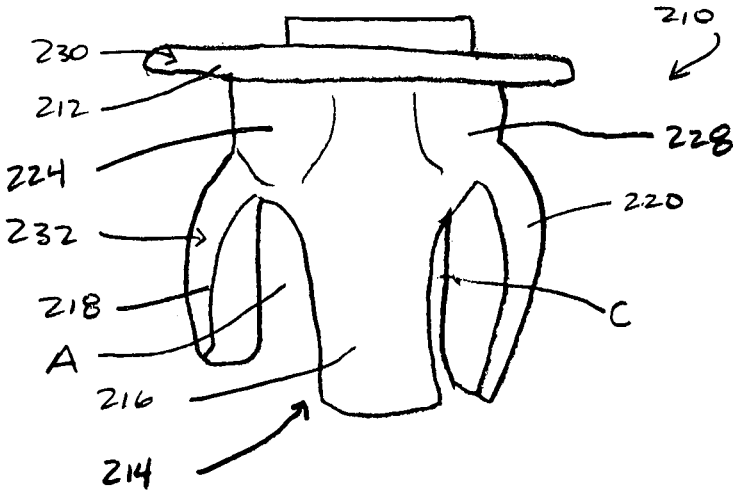
FIGURE 3

FIGURE 16
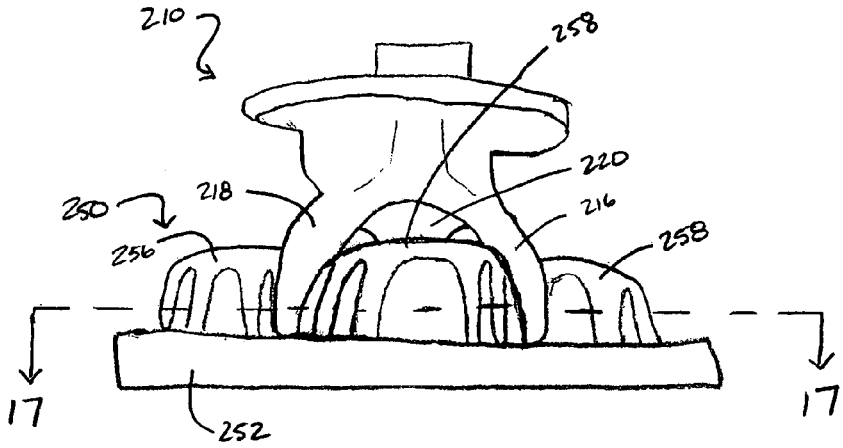
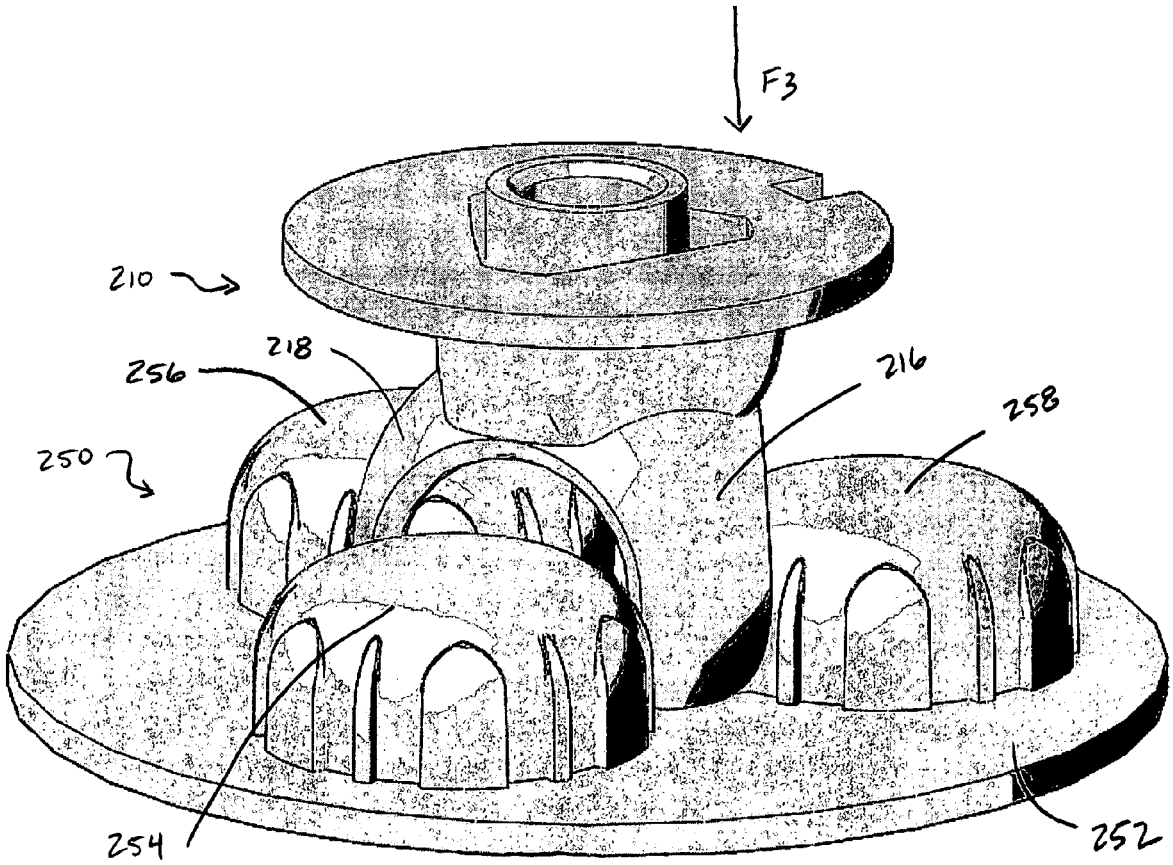
FIGURE 15

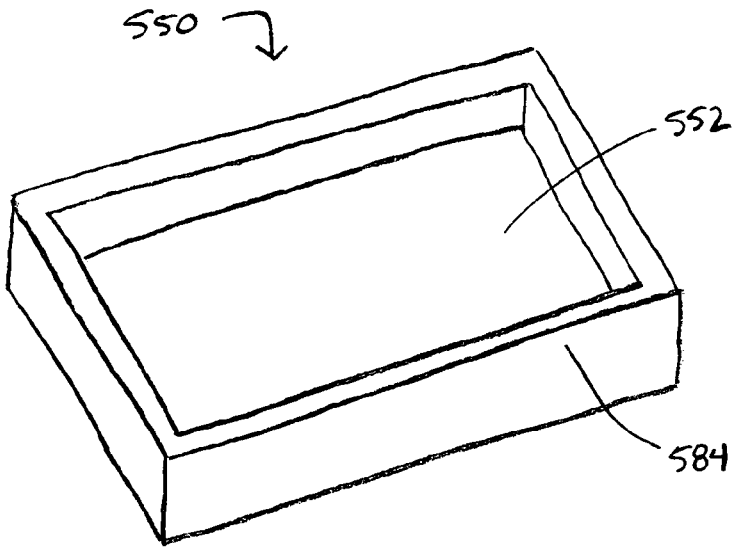
FIGURE 22
FIGURE 23
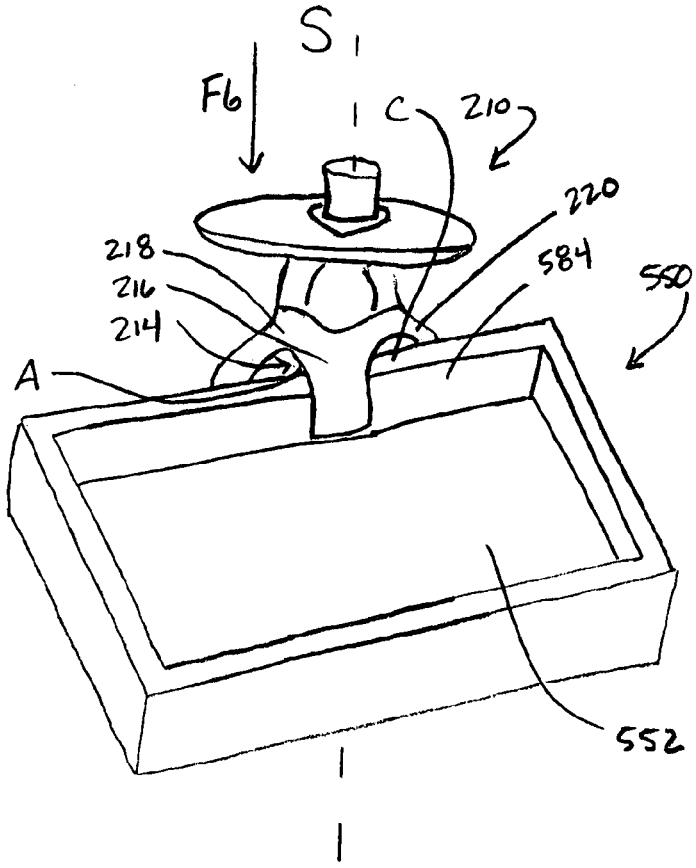

FIGURE 30
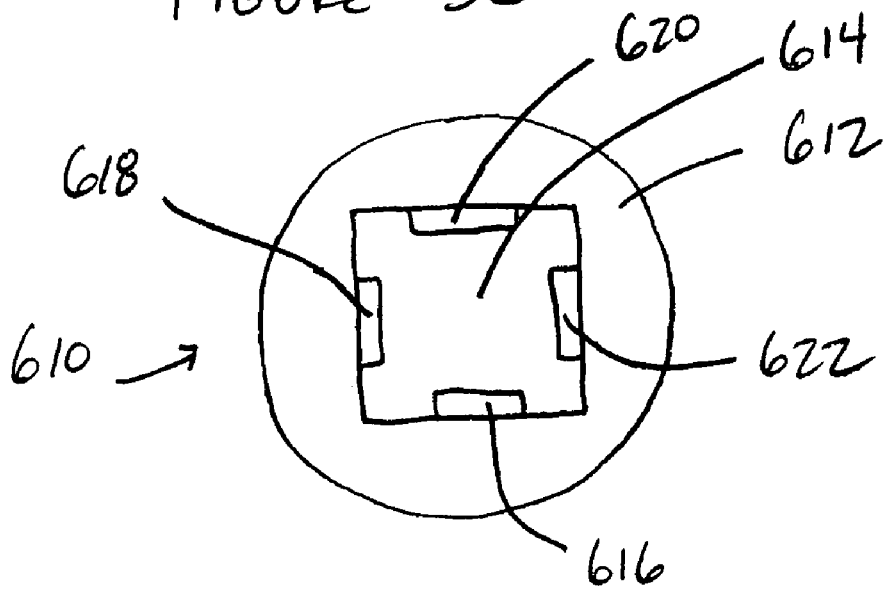
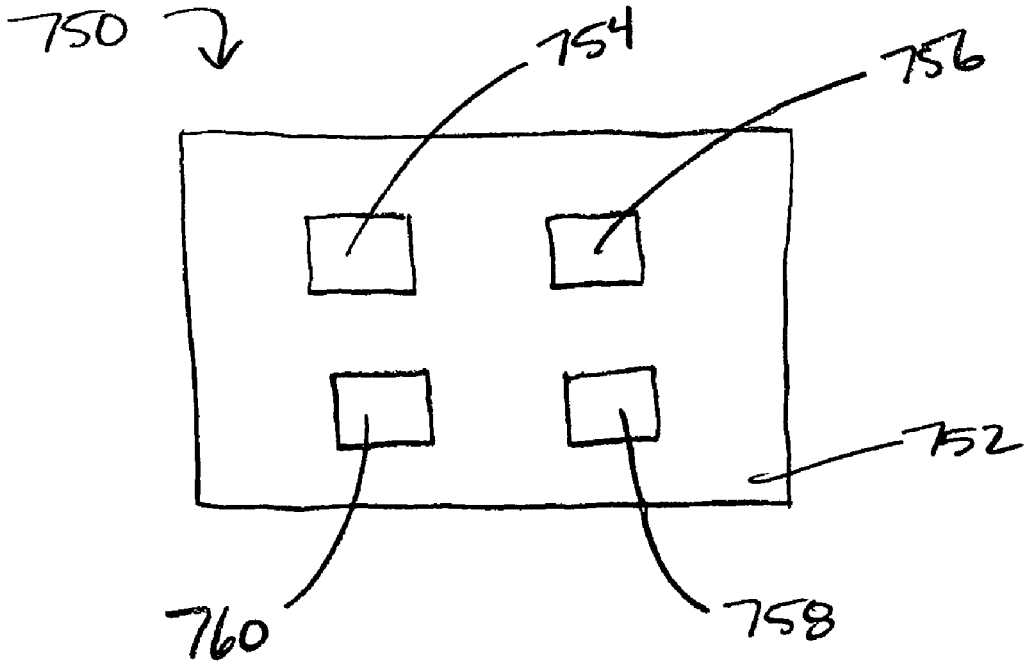
FIGURE 31

FIGURE 32
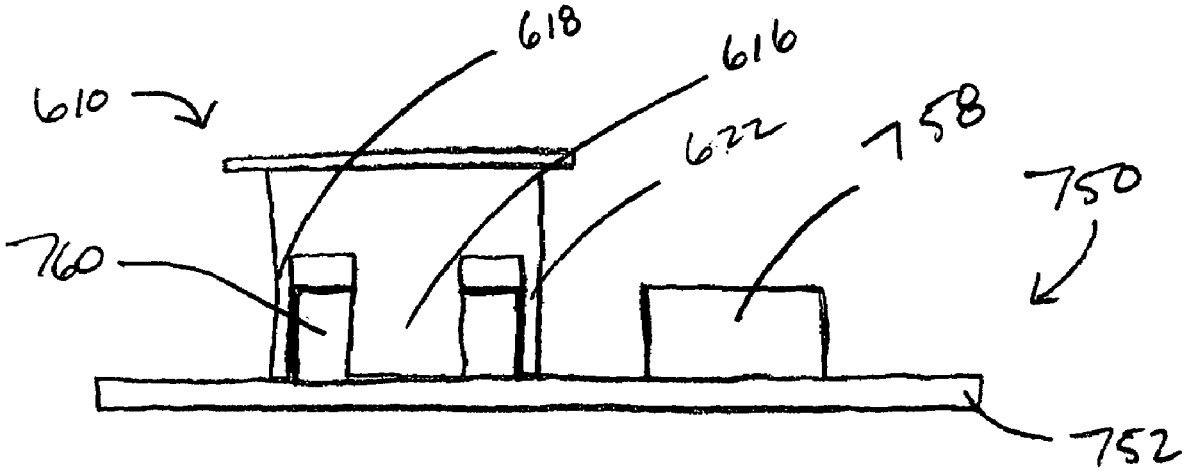
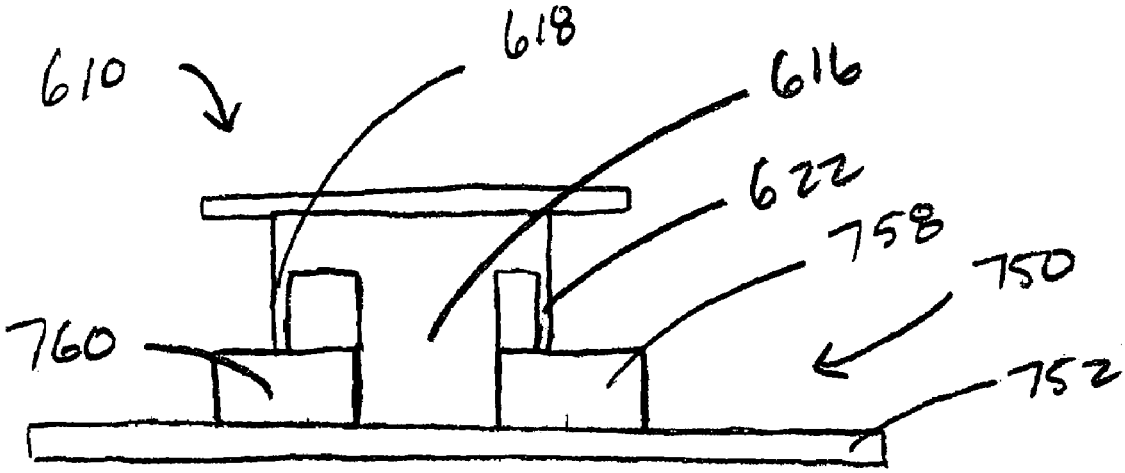
FIGURE 33

CONNECTING TOY

BACKGROUND

The invention relates generally to connecting toys and more particularly to connecting toys that are configured to be connected to items of different geometric shapes.

Children generally enjoy toys that can be changed or modified from one form or configuration to another form or configuration. For example, children enjoy connecting toys or toys that can be selectively coupled together to form different structures and/or different geometric shapes. Several types of connecting toys are known. The known connecting toys, however, cannot be selectively coupled to items of different geometric shapes. Similarly, the known connecting toys cannot be selectively coupled to items of a certain geometric shape and be selectively coupled between the items. Additionally, the known connecting toys are small and are difficult to couple together. Thus, it may be difficult for young children and/or children that lack fine motor skills to use and enjoy the known connecting toys. Finally, the known connecting toys require the user to use imagination to couple the individual items together to build different structures and/or different geometric shapes. Accordingly, it may be difficult for children, such as young children, who lack sufficient imagination to use and enjoy the known connecting toys.

Thus, a need exists for a connecting toy that can be selectively coupled to items of different geometric shapes. A need also exists for a connecting toy that can be selectively coupled to items of a certain geometric shape and be selectively coupled between the items. Additionally, a need exists for a connecting toy that may be easily coupled to other items. Finally, a need exists for a connecting toy that that does not require a large amount of user imagination.

SUMMARY OF THE INVENTION

A toy includes a base member and coupling member. In one embodiment, the base member has, for example, three attachment posts. The coupling member is configured to be removably coupled to any one of the attachment posts. The coupling member is also configured to be removably coupled between and among the three attachment posts. In one embodiment, the coupling member includes three projections that define a receiving portion. The receiving portion is configured to receive at least a portion of any one of the attachment posts. The projections of the coupling member are configured to be coupled among the three attachment posts. In another embodiment, the base member includes a prearranged play area that has a spherical portion, a cylindrical portion, and a wall portion. The coupling member is configured to be removably coupled to the spherical portion, the cylindrical portion, and the wall portion of the base member. In another embodiment, the coupling member includes an entertainment feature, such as, for example, a figure.

BRIEF DESCRIPTION OF THE DRAWINGS

FIG. 2 is a perspective view of a coupling member in accordance with an embodiment of the invention.

FIG. 3 is a side view of the coupling member of FIG. 2.

FIG. 15 is a perspective view of the coupling member of FIG. 2 coupled to the base member of FIG. 7.

FIG. 16 is a side view of the coupling member of FIG. 2 coupled to the base member of FIG. 7.

FIG. 22 is a perspective view of a base member in accordance with another embodiment of the invention.

FIG. 23 is a perspective view of the coupling member of FIG. 2 coupled to the base member of FIG. 22.

FIG. 30 is a bottom view of the coupling member of FIG. 29.

FIG. 31 is a top view of a base member in accordance with another embodiment of the invention.

FIG. 32 is a side view of the coupling member of FIG. 29 coupled to the base member of FIG. 31 in a first configuration.

FIG. 33 is a perspective view of the coupling member of FIG. 29 coupled to the base member of FIG. 31 in a second configuration.

DETAILED DESCRIPTION

A toy includes a base member and coupling member. In one embodiment, the base member has, for example, three attachment posts. The coupling member is configured to be removably coupled to any one of the attachment posts. The coupling member is also configured to be removably coupled between and among the three attachment posts. In one embodiment, the coupling member includes three projections that define a receiving portion. The receiving portion is configured to receive at least a portion of any one of the attachment posts. The projections of the coupling member are configured to be coupled among the three attachment posts. In another embodiment, the base member includes a prearranged play area that has a spherical portion, a cylindrical portion, and a wall portion. The coupling member is configured to be removably coupled to the spherical portion, the cylindrical portion, and the wall portion of the base member. In another embodiment, the coupling member includes an entertainment feature, such as, for example, a figure.

Figure 1:
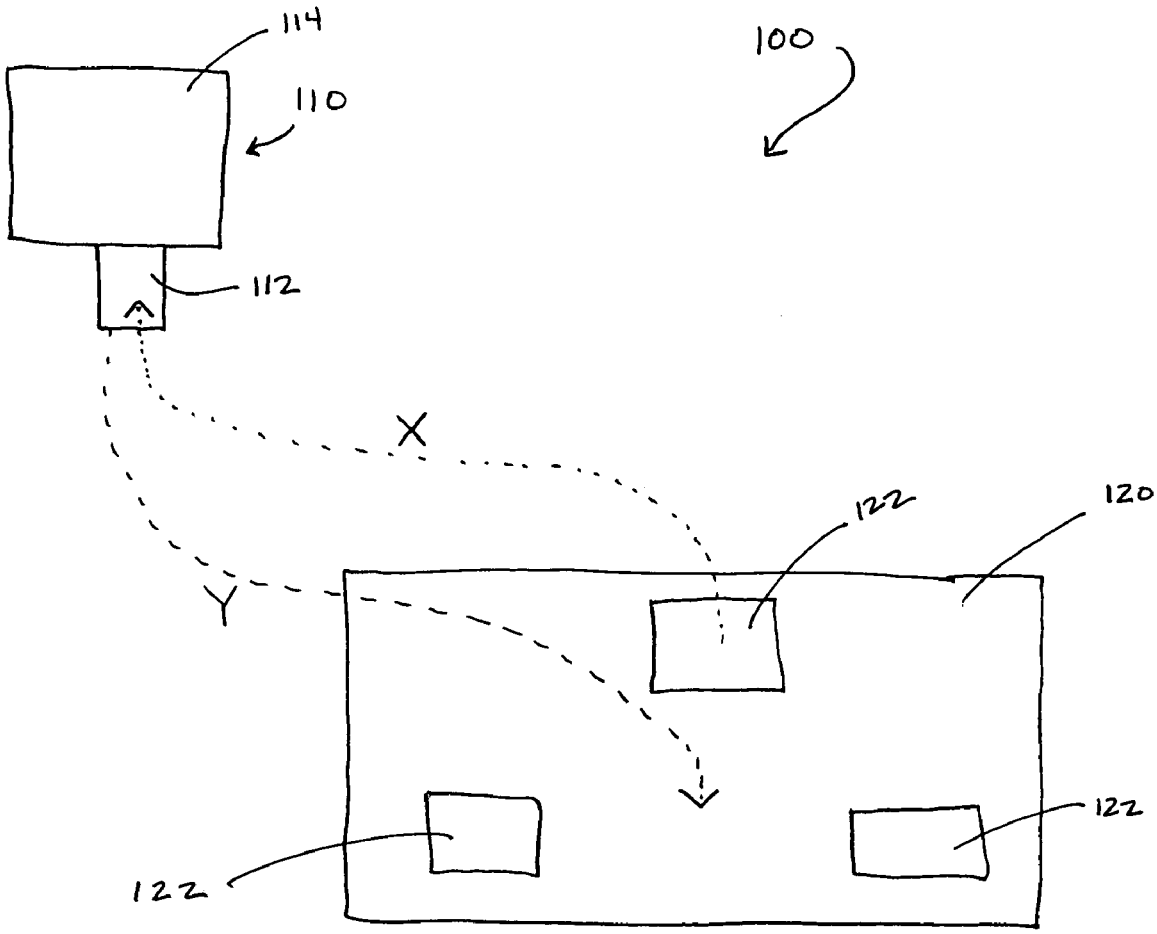
FIG. 1 is a schematic illustration of a toy having a base member and a coupling member in accordance with the invention.

As schematically illustrated in FIG. 1, the connecting toy 100 includes a coupling member 110 and a base member 120. The coupling member 110 includes a body portion 114 and a receiving portion 112. The base member 120 includes several attachment portions 122.

The coupling member 110 may be selectively coupled to the base member 120 at several different locations. As illustrated by dashed line X, the receiving portion 112 is configured to receive a portion of an attachment portion 122 to removably couple the coupling member 110 to the base member 120. Additionally, as illustrated by dashed line Y, the coupling member 110 may be coupled to the base member 120 among coupling portions 122 to removably couple the coupling member 110 to the base member 120.

Figure 4:
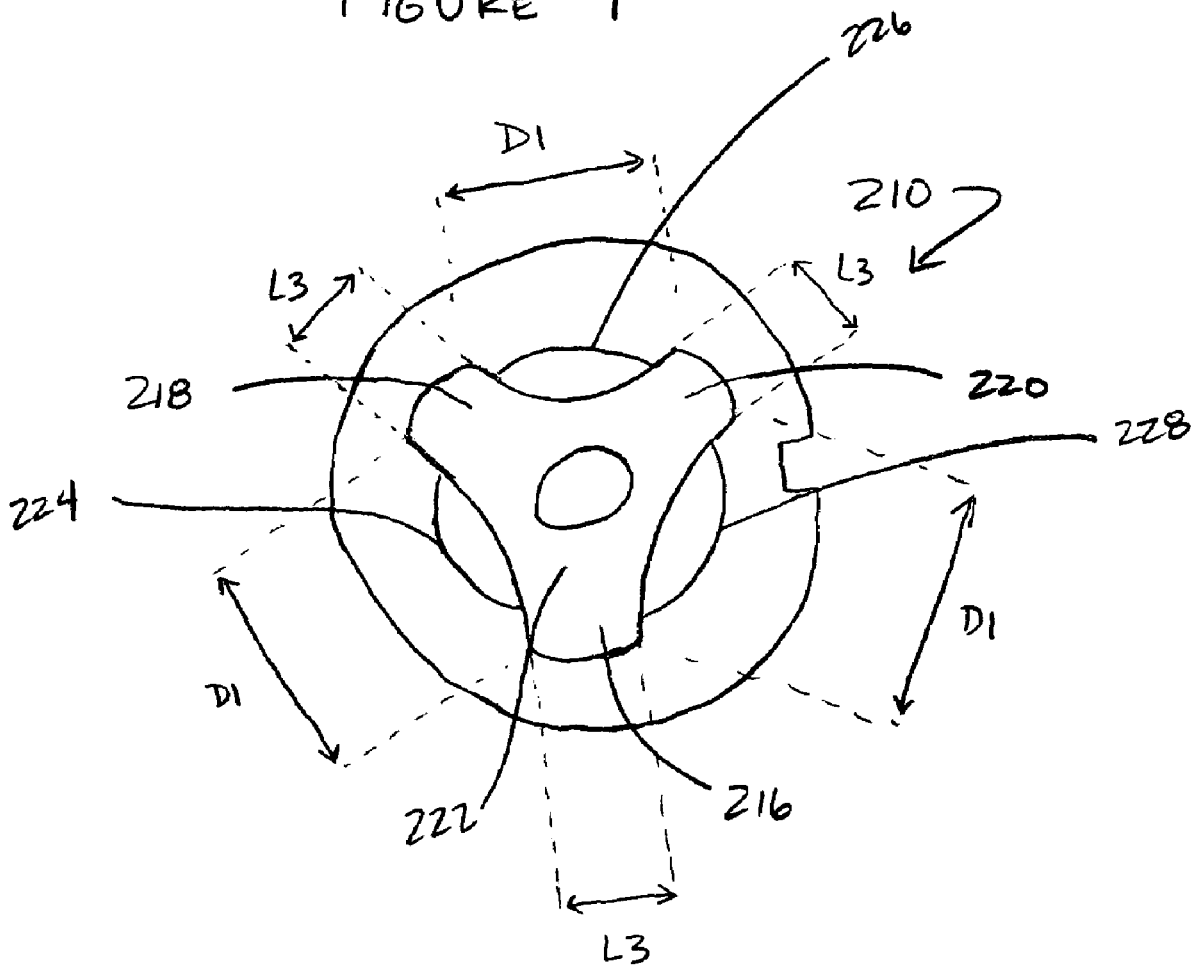
FIG. 4 is a bottom view of the coupling member of FIG. 2.

FIGS. 2 through 4 illustrate a coupling member according to an embodiment of the invention. The coupling member 210 has an upper or body portion 212 and a lower portion 232. The lower portion 232 includes three projections 216, 218, and 220 that extend downwardly from the body portion 212.

In the illustrated embodiment, each of the projections 216, 218, and 220 are equally spaced from the other projections. In other words, a first projection 216 is disposed a distance D1 from a second projection 218 and is disposed the same distance D1 from a third projection 220. Additionally, the second projection 218 is disposed the distance D1 from the third projection 220. Openings A, B, and C are disposed between the projections 216, 218, and 220, respectively. Specifically, opening A is disposed between projection 216 and projection 218. Similarly, opening B is disposed between projection 218 and projection 220, and opening C is disposed between projection 216 and projection 220.

Although the illustrated embodiment includes three projections, it is not necessary that the attachment member have three projections. In another embodiment, the attachment member has a different number of projections, such as 2, 4, or 6. In yet another embodiment, each of the projections is not equally spaced from the other projections. For example, in one embodiment, a first projection is disposed closer to a second projection than a third projection.

The projections 216, 218, and 220 define a receiving portion 214. The projections 216, 218, and 220 are curved such that the receiving portion 214 includes a curved inner surface 222.

In the illustrated embodiment, the projections 216, 218, and 220 are made of molded plastic and are semi-rigid members. In other words, the projections 216, 218, and 220 are generally stiff, but the projections are configured to move or flex from their rest positions when a certain amount of force is applied to the projections. Accordingly, as will be discussed in detail below, the projections 216, 218, and 220 are configured to be moved or flexed from their rest positions to grasp or clamp onto another object to removably couple the coupling member to the object.

In alternative embodiments, not all of the projections are semi-rigid members. For example, in one embodiment, only one of projections is a semi-rigid member. In another embodiment, none of the projections are semi-rigid members. For example, the projections may be rigid members that are pivotally coupled to the coupling member. In such an embodiment, the rigid members may be biased, such as via a spring, to a closed position.

The body portion 212 of the coupling member 210 has three coupling surfaces 224, 226, and 228. The coupling surfaces 224, 226, and 228 are disposed between the openings A, B, and C at a first end 233 of the lower portion 232 and an upper portion 230 of the coupling member, respectively. Specifically, a first coupling surface 224 is disposed between opening A and the upper end portion 230 of the coupling member 210. A second coupling surface 226 is disposed between opening B and the upper end portion 230 of the coupling member 21. A third coupling surface 228 is disposed between opening C and the upper end portion 230 of the coupling member 210.

Figure 5:
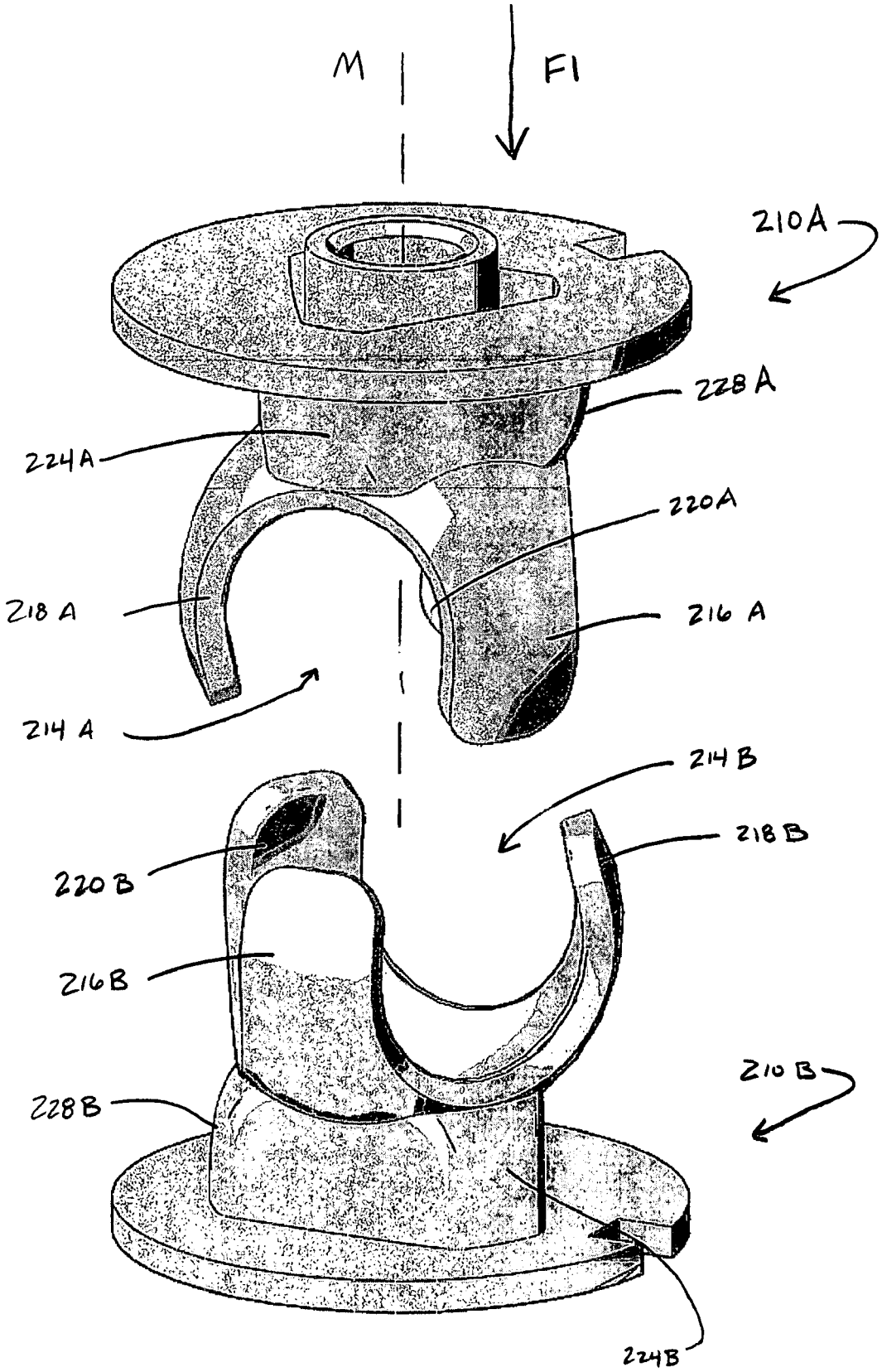
FIG. 5 is a perspective view of two coupling members in accordance with an embodiment of the invention.
Figure 6:
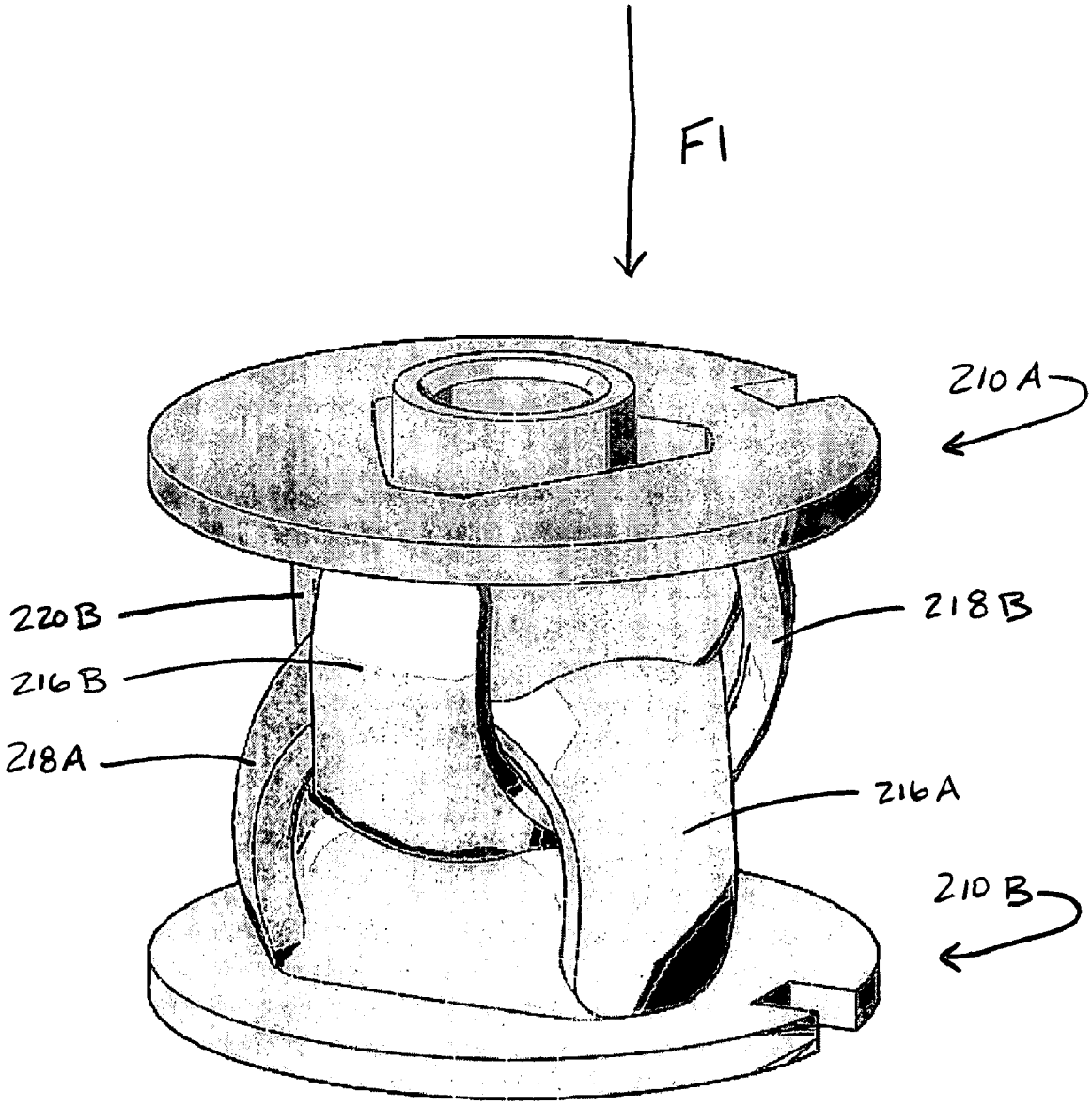
FIG. 6 is a perspective view of the two coupling members of FIG. 5 coupled to one another.

As illustrated in FIGS. 5 and 6, one coupling member 210A may be removably coupled to another coupling member 210B. The receiving portion 214A of coupling member 210A is configured to receive and removably couple to the coupling surfaces 224B, 226B (not illustrated), and 228B of coupling member 210B. Specifically, the projections 216A, 218A, and 220A of coupling member 210A fit over and grip the coupling surfaces 224B, 228B, and 226B of coupling member 210B to frictionally couple coupling member 210A to coupling member 210B. Similarly, the receiving portion 214B of coupling member 210B is configured to receive and removably couple to the coupling surfaces 224A, 226A (not illustrated), and 228A of coupling member 210A. The projections 216B, 218B, and 220B of coupling member 210B fit over and grip the coupling surfaces 224A, 228A, and 226A of coupling member 210A to frictionally couple coupling member 210B to coupling member 210A.

Coupling member 210A may be removably coupled to coupling member 210B by aligning the projections 216A, 218A, and 220A of coupling member 210A with the coupling surfaces 224B, 228B, and 226B of coupling member 210B as illustrated in FIG. 5. Accordingly, projections 216B, 218B, and 220B of coupling member 210B are aligned with the coupling surfaces 224A, 228A, and 226A of coupling member 210A. A force may then be applied to the coupling member 210A and/or to the coupling member 210B to couple the coupling members 210A and 210B to each other. For example, a force in the direction of arrow F1 may be applied to the coupling member 210A to removably couple the coupling member 210A to the coupling member 210B.

The force applied to the coupling member 210A and/or to the coupling member 210B causes the receiving portion 214A of coupling member 210A to receive the coupling surfaces 224B, 226B, and 228B of coupling member 210B. Specifically, the applied force causes the projections 224A, 226A, and 228A to bend or flex to fit over and grip the coupling surfaces 224B, 228B, and 226B. Similarly, the force applied to the coupling member 210A and/or to the coupling member 210B causes the receiving portion 214B of coupling member 210B to receive the coupling surfaces 224A, 226A, and 228A of coupling member 210A. Specifically, the applied force causes the projections 224B, 226B, and 228B to bend or flex to fit over and grip the coupling surfaces 224A, 228A, and 226A of coupling member 210A. Although as illustrated, the coupling member 210A is coupled to the coupling member 210B in a specific orientation, the coupling member 210A may be rotated 120 or 240 degrees with respect to the coupling member 210B about axis M prior to coupling the coupling member 210A to the coupling member 210B.

Coupling member 210A may be removed or uncoupled from coupling member 210B by applying a force to the coupling member 210A and/or to the coupling member 210B. For example, a force in a direction opposite to the direction of arrow F1 may be applied to the coupling member 210A. When such a force is applied to the coupling member 210A the projections 216A, 218A, and 220A are removed from their engagement with the coupling surfaces 224B, 228B, and 226B. Similarly, the projections 216B, 218B, and 220B are removed from their engagement with the coupling surfaces 224A, 228A, and 226A. The coupling member 210A is thereby removed or uncoupled from the coupling member 210B.

Figure 7:
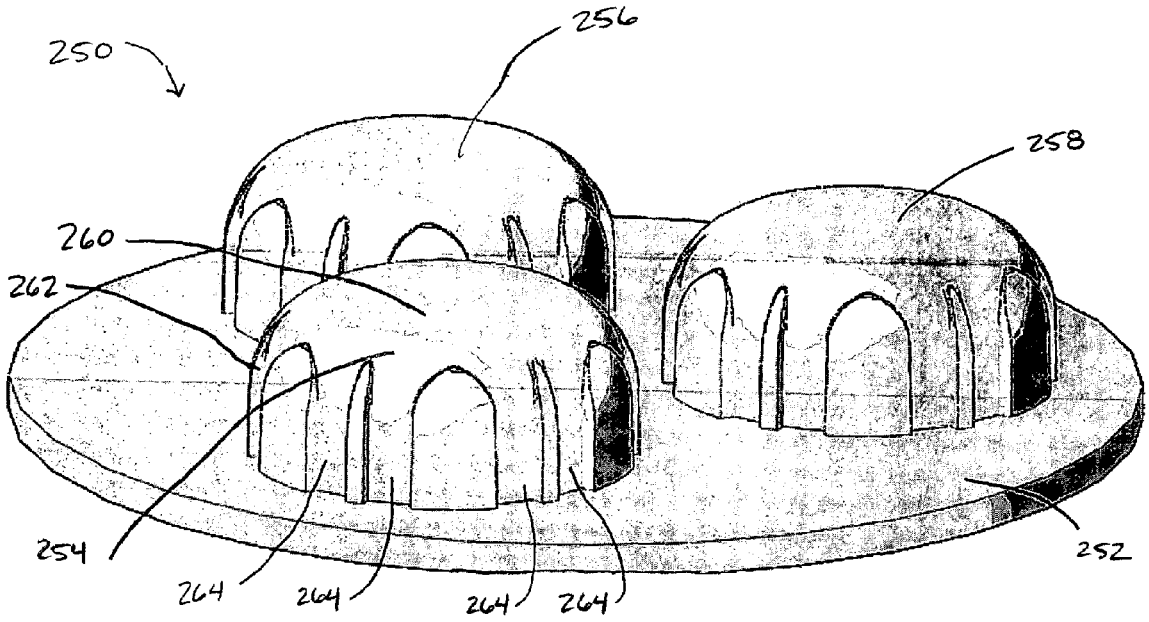
FIG. 7 is a perspective view of a base member in accordance with an embodiment of the invention.
Figure 8:
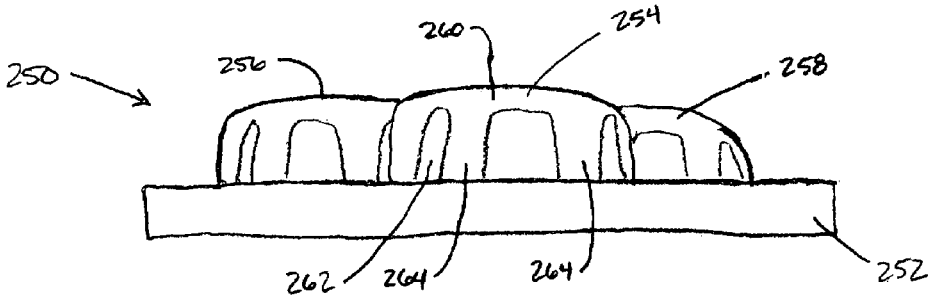
FIG. 8 is a side view of the base member of FIG. 7.
Figure 9:
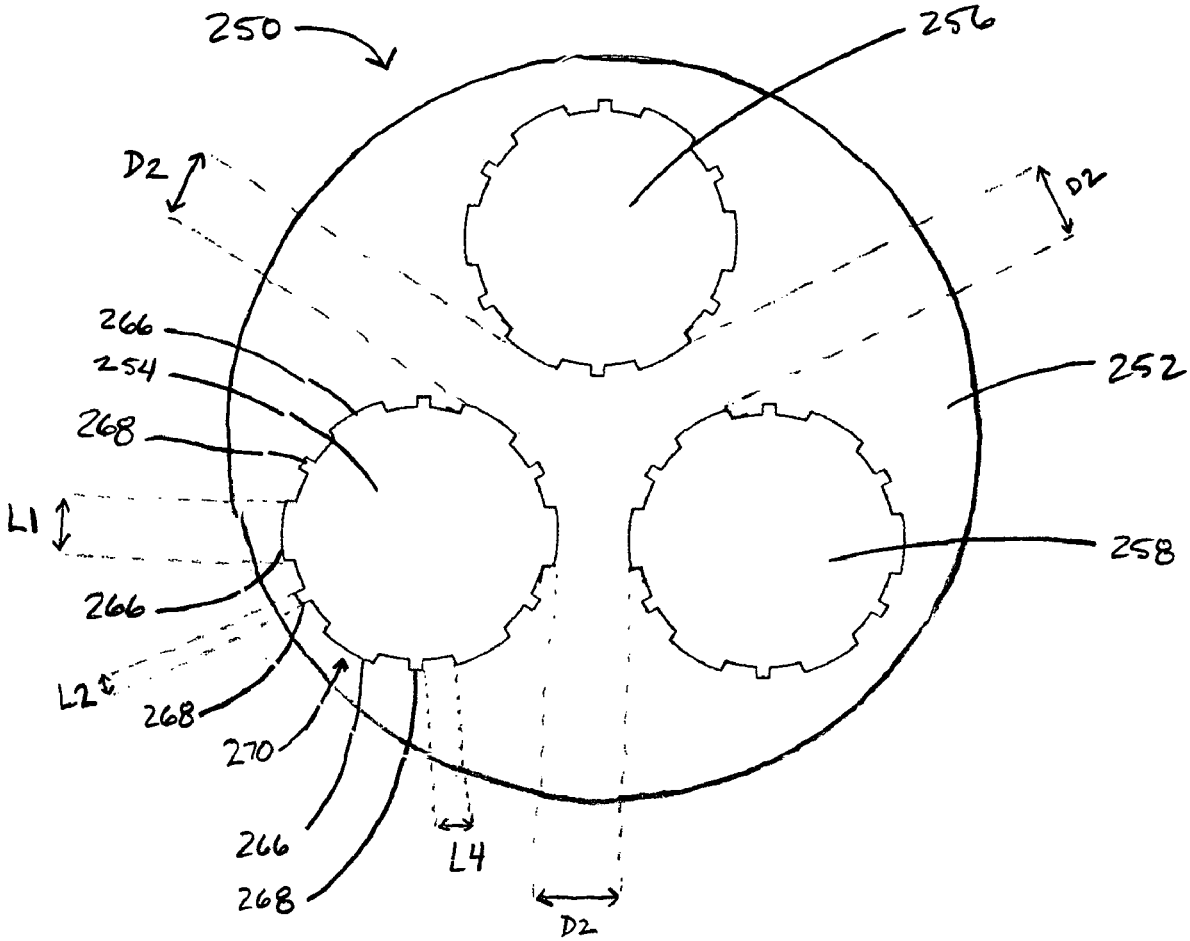
FIG. 9 is a top view of the base member of FIG. 7.

FIGS. 7 through 9 illustrate a base member according to an embodiment of the invention. The base member 250 includes a support portion 252 and a set of three mutually adjacent attachment posts 254, 256, and 258 that extend from the support portion 252. The term "mutually adjacent" is used herein to mean that each item is disposed directly adjacent to each of the other items. For example, a set of three mutually adjacent attachment posts is a set of three attachment posts where a first attachment post is disposed directly adjacent to a second attachment post, the second attachment post is disposed directly adjacent to a third attachment post, and the third attachment post is disposed directly adjacent to the first attachment post.

In the illustrated embodiment, each of the attachment posts 254, 256, and 258 are equally spaced from the other attachment posts. In other words, a first attachment post 254 is disposed a distance D2 from a second attachment post 256, the second attachment post 256 is disposed the distance D2 from the third attachment post, and the third attachment post 258 is disposed the distance D2 from the first attachment post 254.

Although the illustrated embodiment includes three attachment posts, it is not necessary that the base member have three attachment posts. In another embodiment, the base member has a different number of attachment posts, such as, for example, 2, 4, or 6. In yet another embodiment, each of the attachment posts is not equally spaced from the other attachment posts. For example, in one embodiment, a first attachment post is disposed closer to a second attachment post than a third attachment post.

All of the attachment posts 254, 256, and 258 are substantially similar in function and shape. Accordingly, only attachment post 254 will be discussed in detail. The attachment post 254 includes a top portion 260 and a side wall 262. It is not necessary, however, that the attachment posts have the same shape. In another embodiment, one attachment post has one shape and another attachment post has another shape. For example, in one embodiment, one attachment post has a cylindrical shape and another attachment post has a cubical shape.

As best illustrated in FIGS. 7 and 9, the side wall 262 of attachment post 254 has several slots or grooves 264 defined therein. The slots or grooves 264 extend from the top portion 260 of the attachment post 264 to the support portion 252 of the base member 250. In an alternative embodiment, the slots or grooves do not extend from the top portion of the attachment post to the support portion of the base member, but rather they extend only part of that distance.

As best illustrated in FIG. 9, all of the slots or groves 264 are substantially the same shape and size. The outermost perimeter 270 of the side wall 262 includes several large separating portions 266 and several small separating portions 268 that define and separate the slots or grooves 264. The arc length L1 of the large separating portions 266 is larger than the arc length L2 of the small separating portions 268. The large separating portions 266 and the small separating portions 268 alternate between the slots or grooves 264. In other words, each slot or groove 264 is bounded on one side by a large separating portion 266 and is bounded on another side by a small separating portion 268. In the illustrated embodiment, the arc length L1 of each of the large separating portions 266 is the same. Similarly, the arc length L2 of each of the small separating portions 268 is the same.

In another embodiment, the slots or grooves are of different sizes and shapes. In yet another embodiment, the arc length of the large separating portions and the arc length of the small separating portions are the same. In a further embodiment, the arc length of the each of the large separating portions is not the same. In a further embodiment, the arc length of each of the small separating portions is not the same.

FIGS. 10 through 13 illustrate a coupling member and a portion of the base member. As best illustrated in FIGS. 10 through 13, the coupling member 210 may be removably coupled to any one of the attachment posts 254, 256, and 258. For simplicity purposes, only the coupling between coupling member 210 and attachment post 254 is described in detail and illustrated in FIGS. 10 through 13.

Figure 10:
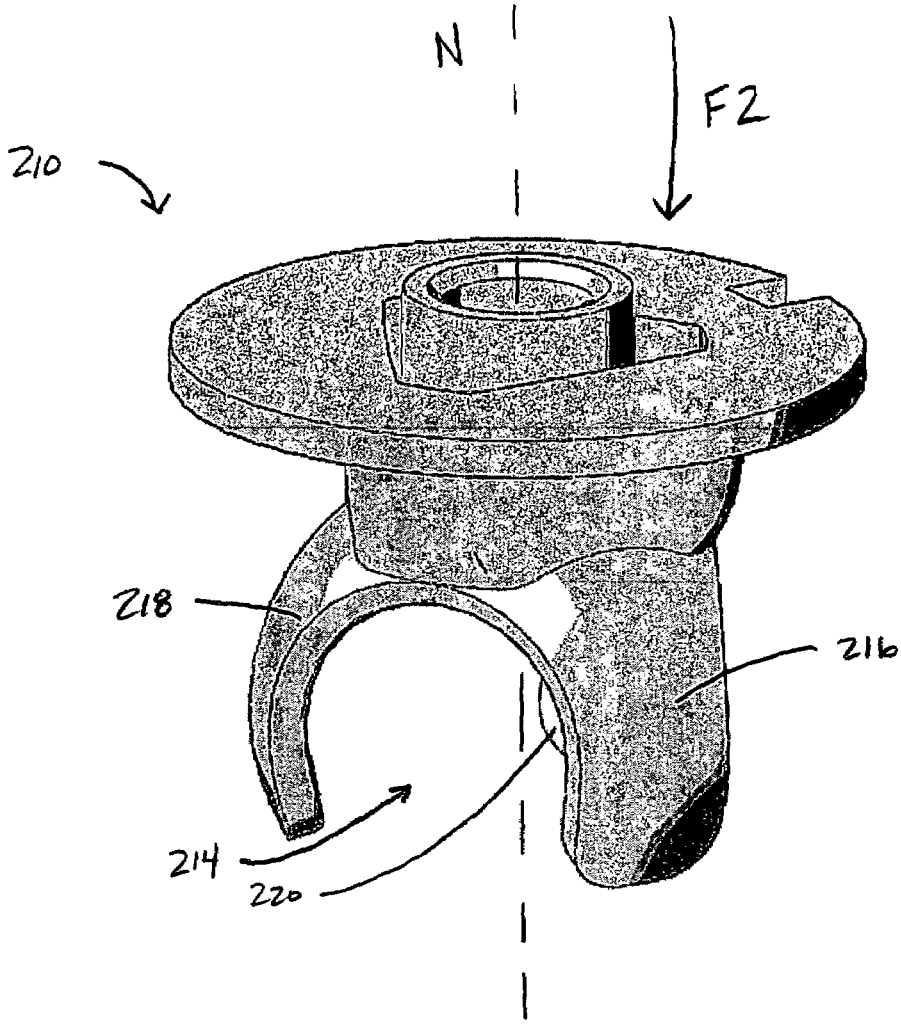
FIG. 10 is a perspective view of the coupling member of FIG. 2 and a portion of the base member of FIG. 7.
Figure 10:
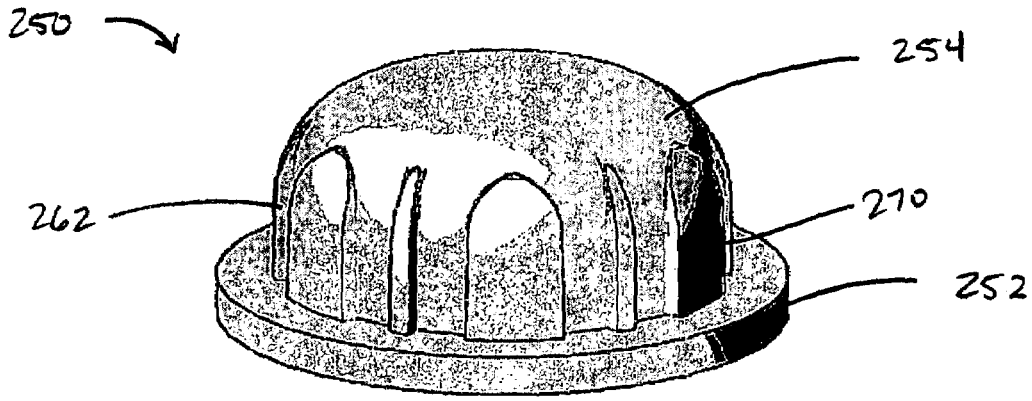
Figure 11:
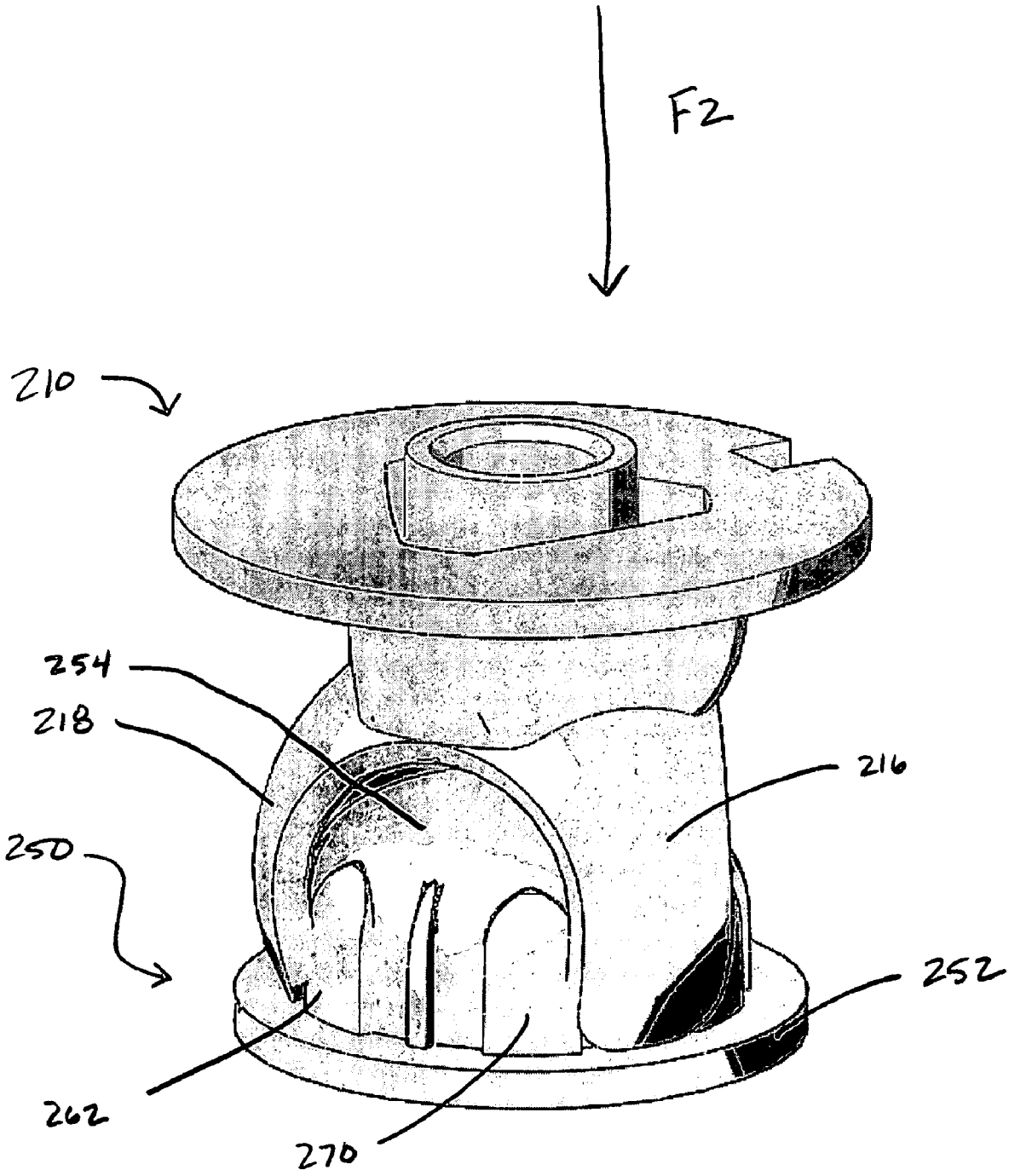
FIG. 11 is a perspective view of the coupling member of FIG. 2 coupled to a portion of the base member of FIG. 7.
Figure 12:
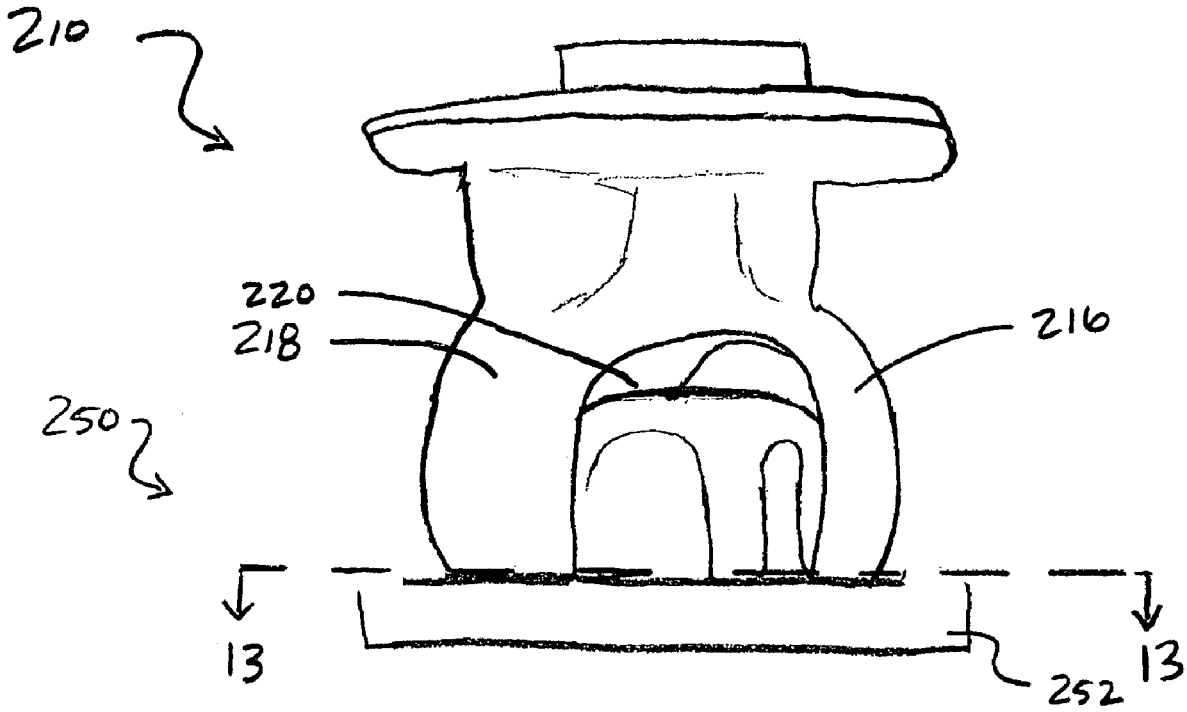
FIG. 12 is a side view of the coupling member of FIG. 2 coupled to a portion of the base member of FIG. 7.

As illustrated in FIG. 10, to removably couple the coupling member 210 to the base member 250, the projections 216, 218, and 220 of the coupling member 210 are substantially aligned with the outermost perimeter 270 of the side wall 262 of the attachment post 254. A force is then applied to the coupling member 210 and/or to the attachment post 254 to couple the coupling member 210 to the base member 250. For example, a force in the direction of arrow F2 may be applied to the coupling member 210 to couple the coupling member 210 to the base member 250.

Figure 13:
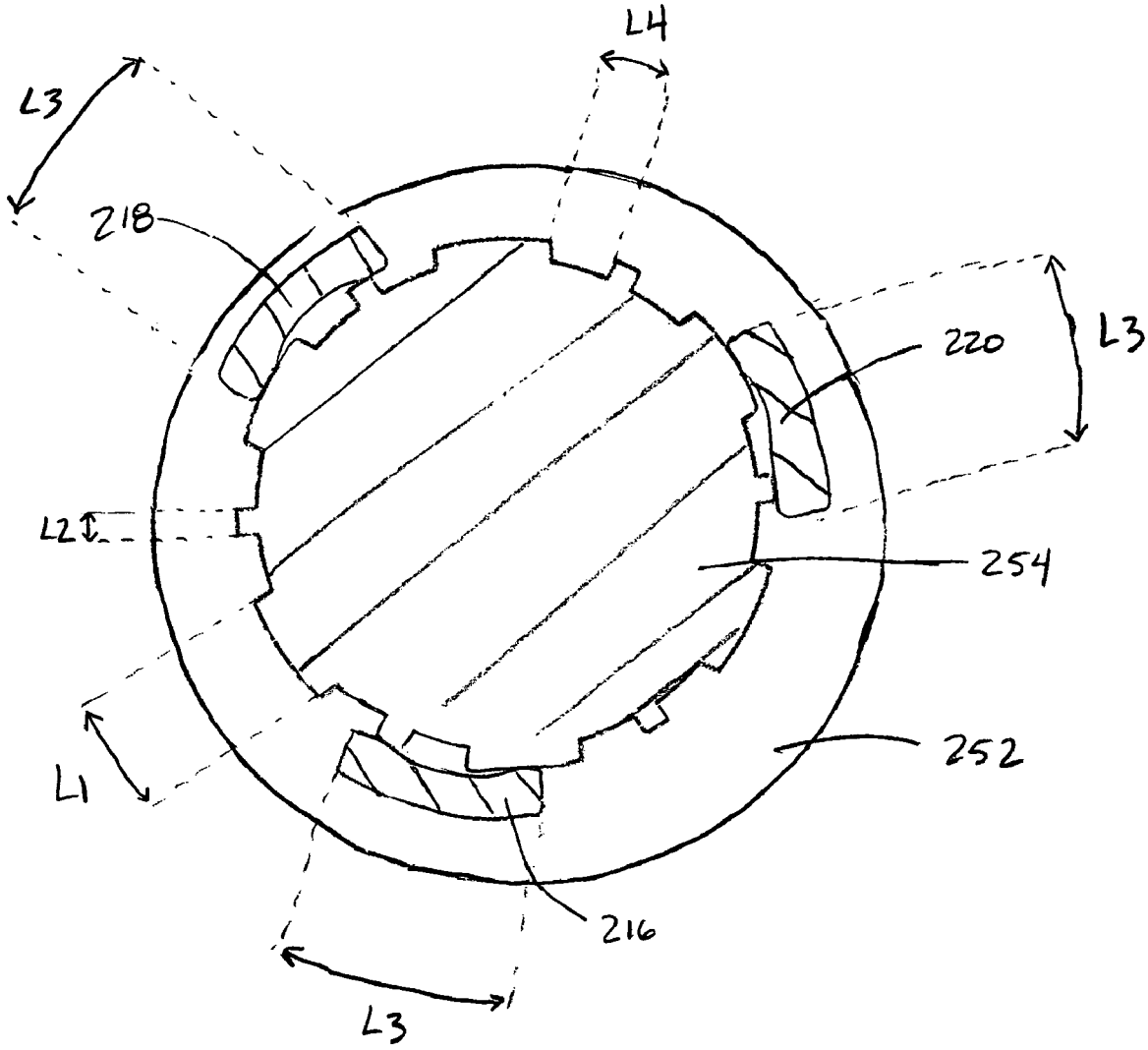
FIG. 13 is a cross-sectional view of the coupling member coupled to the portion of the base member as illustrated in FIGS. 11 and 12 taken along the line 13—13 in FIG. 12.
Figure 14:
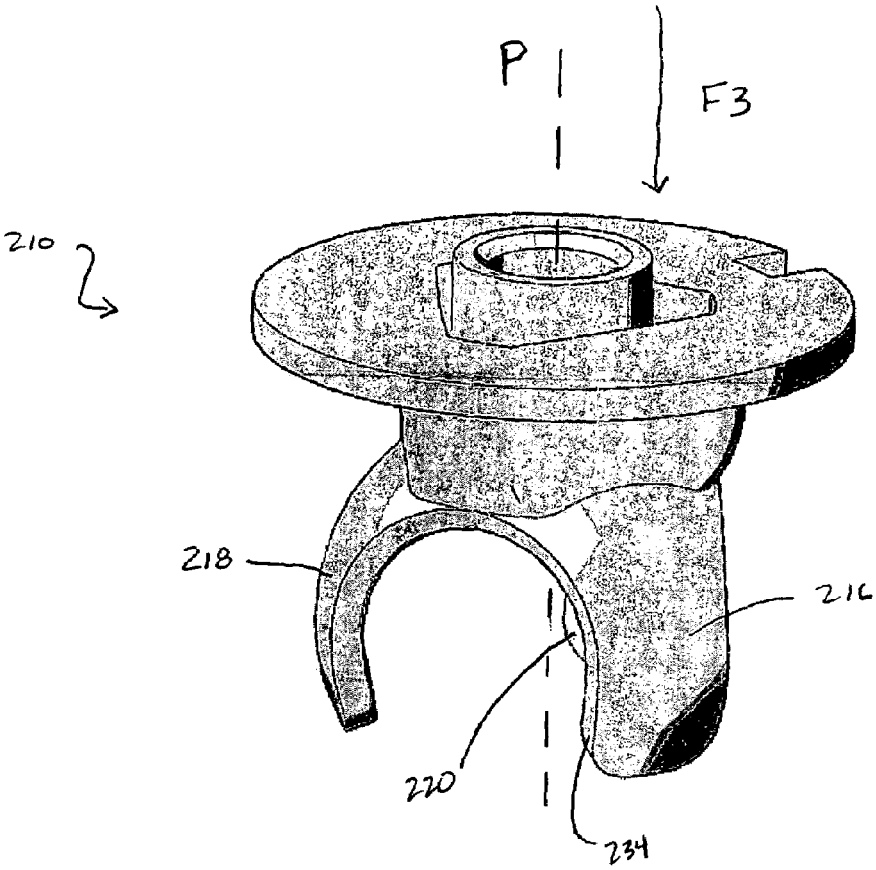
FIG. 14 is a perspective view of the coupling member of FIG. 2 and the base member of FIG. 7.
Figure 14:
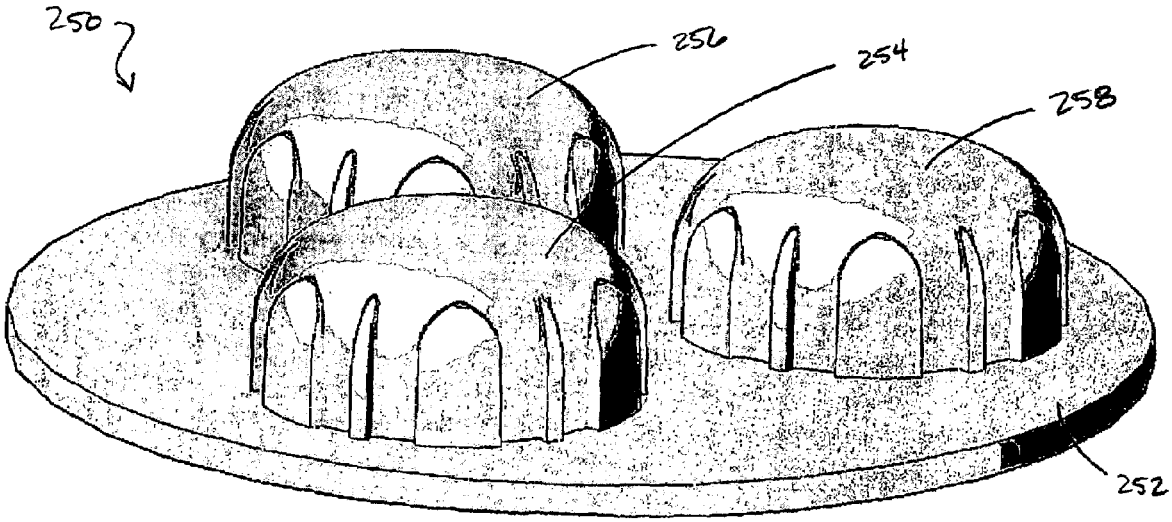

The force applied the coupling member 210 and/or to the base member 250 causes the receiving portion 214 of the coupling member 210 to receive a portion of the attachment post 254. Specifically, the applied force causes the projections 216, 218, and 220 to bend or flex to fit over and grip the outermost perimeter 270 of the attachment post 254. As best illustrated in FIG. 13, the arc length L3 of each of the projections 216, 218, and 220 is larger than the arc length L4 of the slots or grooves 264. Accordingly, in the illustrated embodiment, each of the projections 216, 218, and 220 can engage and grip at least a portion of at least one of the large separating portions 266 and the small separating portions 268. Although the coupling member 210 is illustrated as being coupled to the attachment post 254 in a particular orientation, after coupling the coupling member 210 to the attachment post 254, the coupling member 210 may be rotated with respect to the attachment post 254 about axis N to any orientation. Additionally, prior to coupling the coupling member 210 to the base member 250, the coupling member 210 may be rotated with respect to the attachment post 254 about axis N to any orientation.

The coupling member 210 may be removed or uncoupled from the attachment post 254 by applying a force to the coupling member 210 and/or to the base member 250. For example, the coupling member 210 may be removed from the attachment post 254 by applying a force to the coupling member 210 in a direction opposite to the arrow F2. When such force is applied to the coupling member 210 and/or to the base member 250 the projections 216, 218, and 220 are removed from their engagement with the large separating portions 266 and the small separating portions 268 of the attachment post 254.

As illustrated in FIGS. 14 through 17, the coupling member 210 may be removably coupled to the base member 250 between and among the attachment posts 254, 256, and 258. Specifically, as illustrated in FIG. 13, the coupling member 210 is aligned with the base member 250 such that each of the projections 216, 218, and 220 are each aligned between a pair of the attachment posts 254, 256, and 258. Accordingly, the coupling member 210 is coupled to the base member 250 among the attachment posts 254, 256, and 258. For example, projection 216 is aligned between attachment post 254 and 258, projection 218 is aligned between 254 and 256, and projection 220 is aligned between 256 and 258. A force is then applied to the coupling member 210 and/or to the base member 250 to couple the coupling member 210 to the base member 250. For example, a force in the direction of arrow F3 may be applied to the coupling member 210, to couple the coupling member 210 to the base member 250.

The force applied to the coupling member 210 and/or to the base member 250 causes the projections 216, 218, and 220 to be inserted among, and frictionally coupled to, the attachment posts 254, 256, and 258. The engagement among the projections 216, 218 and 220 and the attachment posts 254, 256, and 258 are structurally and functionally similar. Thus, only the engagement between the projection 216 and the attachment posts 254 and 256 will be described in detail.

Figure 17:
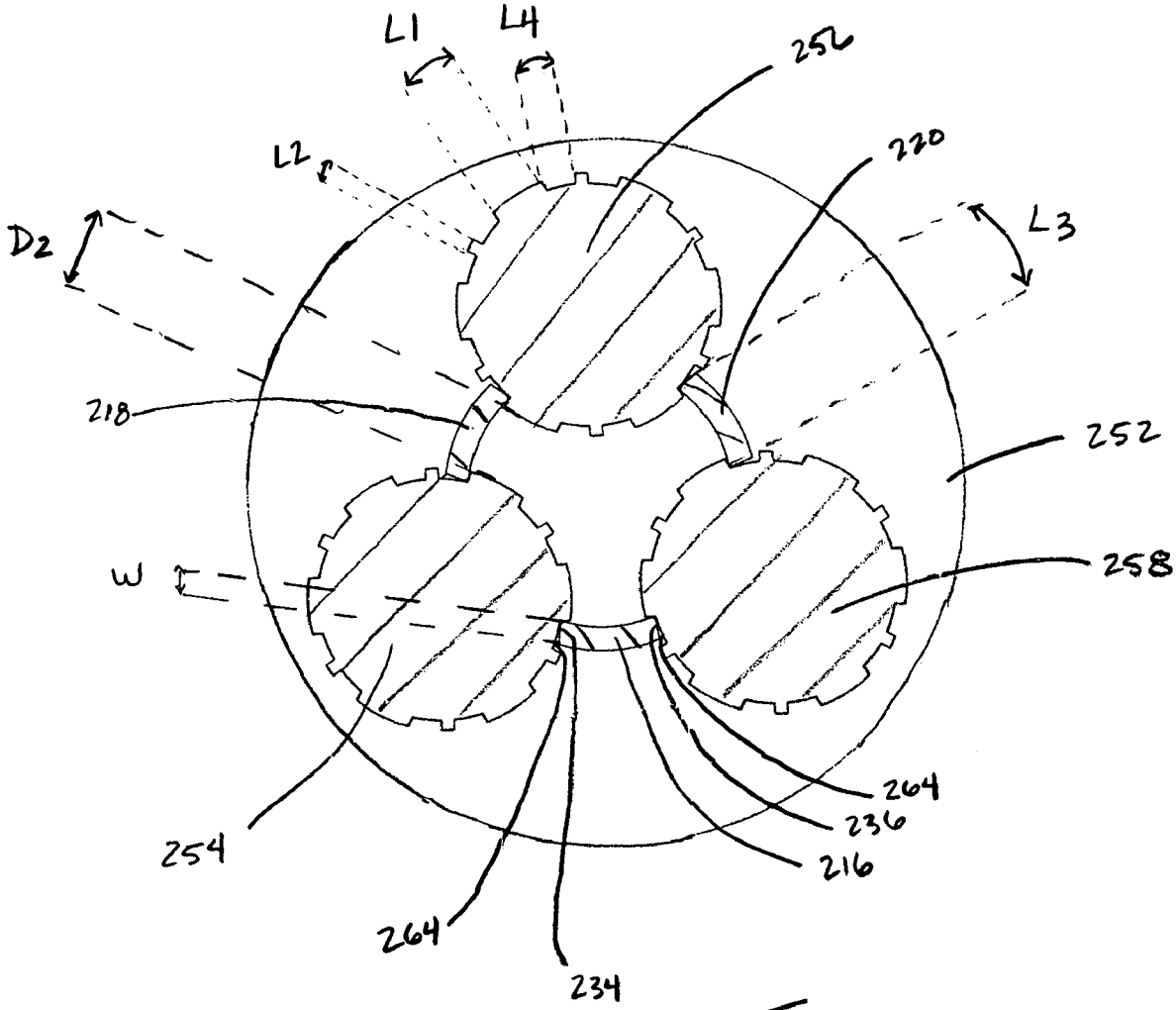
FIG. 17 is a cross-sectional view of the coupling member coupled to the base member as illustrated in FIGS. 15 and 16 taken along the line 17—17 in FIG. 16.

In the illustrated embodiment, the projection 216 is inserted and coupled between attachment posts 254 and 256. The arc length L3 of the projection 216 is slightly larger than the distance D2 between the attachment post 254 and the attachment post 256. Additionally, the width W of edges 234 and 236 of the projection 216 is smaller than the arc length L4 of the slots or grooves 264 of the attachment posts 254 and 256, respectively. Accordingly, as best illustrated in FIGS. 15 and 17, when the projection is disposed between attachment posts 254 and 258, the edges 234 and 236 of the projection 216 are disposed within the grooves 264 of attachment posts 254 and 258. The engagement of the edges 234 and 236 of the projection 216 with the slots or grooves 264 assist with the alignment of the projection 216 with the attachment posts 254 and 258 and aid in preventing the attachment member 210 from easily rotating with respect to the base member 250 when the attachment member 210 is coupled to the base member 250 such that the projections 216, 218, and 220 are disposed among the attachment posts 254, 256, and 258. In one embodiment, the large separating portions and the small separating portions engage a front surface and a rear surface of the projection, respectively, to guide and retain the projection within the groove Although the projection 216 is illustrated as being inserted and frictionally coupled between attachment posts 254 and 258, the projection 216 need not be inserted and frictionally coupled between attachment posts 254 and 258. For example, the coupling member may be rotated 120 or 240 degrees with respect to the base member 250 about axis P prior to applying the coupling force to the coupling member 210 and/or to the base member 250. Accordingly, projection 216 may be inserted and frictionally coupled between attachment posts 254 and 258, attachment posts 254 and 256, or attachment posts 256 and 258.

The coupling member 210 may be removed or uncoupled from the base member 250 by applying a force to the coupling member 210 and/or the base member 250. For example, the projections 216, 218, and 220 of the coupling member 210 may be removed from among the attachment posts 254, 256, and 258 by applying a force to the coupling member 210 in a direction opposite to the arrow F3.

In an another embodiment, the attachment posts do not include slots or grooves. Rather, the outermost perimeter of the side wall of the attachment portion is a continuous surface. Accordingly, when the coupling member is coupled among a set of mutually adjacent attachment posts, the projections extend from a side wall of one attachment post to a side wall of another attachment post.

Figure 18A:
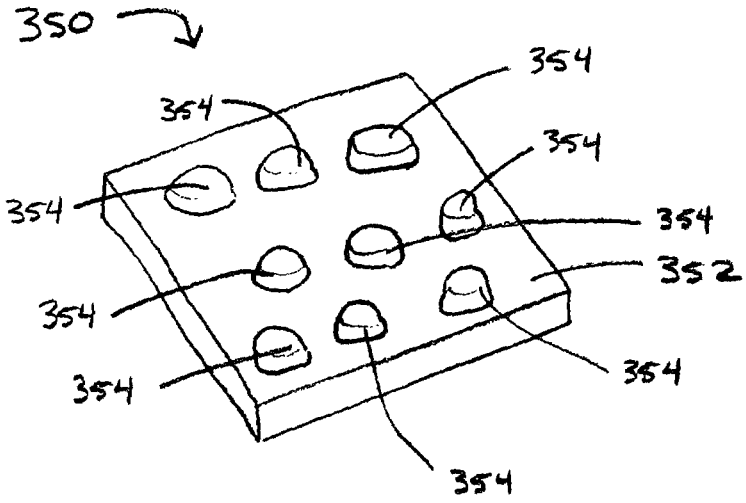
FIG. 18A is a perspective view of a base member in accordance with another embodiment of the invention.
Figure 18B:
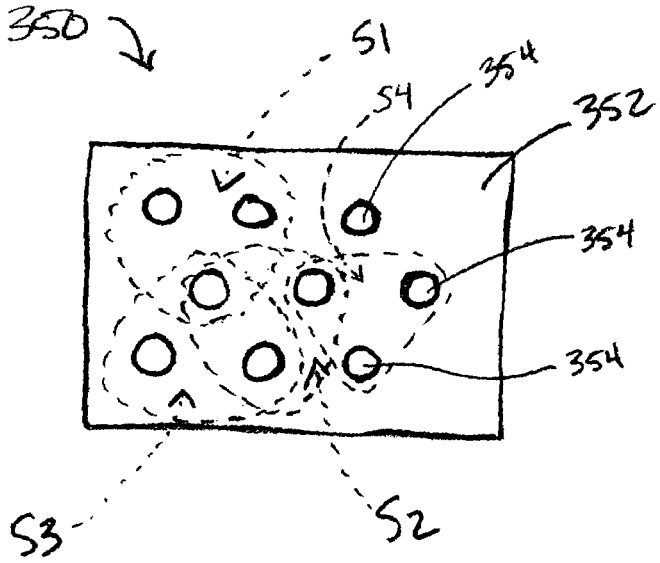
FIG. 18B is a top view of the base member of FIG. 18A.

FIGS. 18A and 18B illustrate another embodiment of the base member. The base member 350 includes a support portion 352 and several rows of attachment posts 354 that extend from the support portion 352. FIG. 18B is a top view of base member 350. As illustrated, base member 350 includes several rows of attachment posts arranged in a repeating pattern. Specifically, the base member 350 includes several sets of three mutually adjacent attachment posts (several of the sets of are identified as S1, S2, S3, and S4). In such an embodiment, the coupling member 210 can be removably coupled to any one of the attachment posts 354. Additionally, the coupling member can be removably coupled among any set of three mutually adjacent attachment posts 354.

Figure 19A:
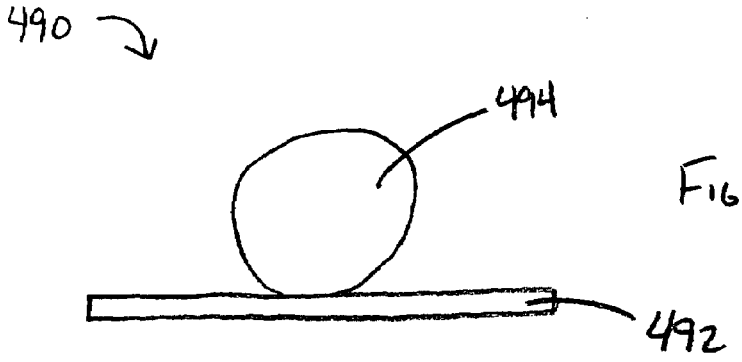
FIG. 19A is a perspective view of a base member in accordance with another embodiment of the invention.
Figure 19B:
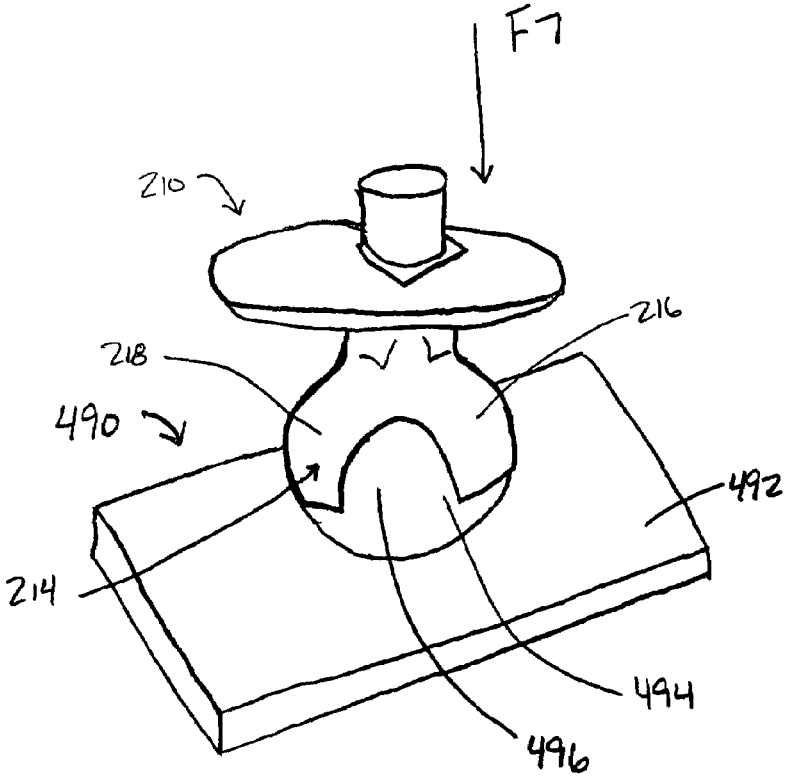
FIG. 19B is a perspective view of the coupling member of FIG. 2 coupled to the base member of FIG. 19A.
Figure 19C:
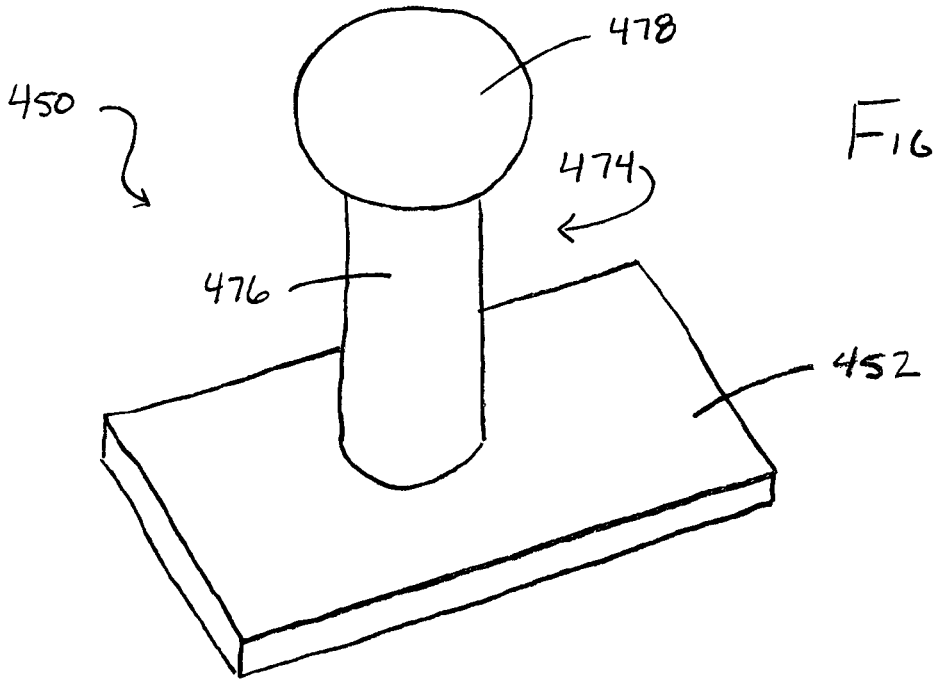
FIG. 19C is a perspective view of a base member in accordance with another embodiment of the invention.

FIGS. 19A and 19B illustrate a base member according to another embodiment of the invention. The base member 490 includes a support portion 492 and a spherical portion 494 that extends from the support portion 492. As illustrated in FIG. 19B, the coupling member 210 may be removably coupled to the spherical portion 494 of the base member 490. Specifically, the receiving portion 214 of the coupling member 210 receives a portion of the spherical portion 494 of the base member 490. The projections 216, 218, and 220 of the coupling member 210 engage an outer surface 496 of the spherical portion 494 and frictionally couple the coupling member 210 to the spherical portion 494.

In the illustrated embodiment, the inner surface 222 of the coupling member 210 frictionally grips the outer surface 496 of the spherical portion. In other words, the radius of curvature of the inner surface 222 of the coupling member 210 is substantially the same as the radius of curvature of the outer surface 496 of the spherical portion 494. In another embodiment, the projections extend around a substantial portion of the spherical portion of the extension member to capture or otherwise retain the spherical portion within the receiving portion of the coupling member. In such an embodiment, the radius of curvature of the receiving portion is larger than the radius of curvature of the outer surface of the spherical portion of the extension member.

Similar to the above embodiments, a force is applied to at least one of the coupling member 210 and the spherical portion 494 of the base member 490 to removably couple the coupling member 210 to the spherical portion 494. For example, a force in the direction of arrow F7 may be applied to the coupling member 210 by grasping the coupling member 210 and pressing the coupling member 210 against the spherical portion 494. Such force causes the projections 216, 218, and 220 to bend or flex to fit over and grip the outer surface 496 of the spherical portion 494 to frictionally couple the coupling member 210 to the base member 490. Although the coupling member 210 is illustrated as being coupled to the spherical member 494 in one orientation, the coupling member 210 may be coupled to the spherical member 494 in any orientation. For example, the coupling member 210 may be coupled to the spherical member 494 such that the coupling member 210 extends substantially perpendicular to the base member 490. Alternatively, the coupling member 210 may be coupled to the spherical member 494 such that the coupling member extends substantially parallel to the base member 490 or at any orientation with respect to the base member 490.

To remove the coupling member 210 from the spherical portion 494, a force is applied to at least one of the coupling member 210 and the spherical portion 494. For example, a force in a direction opposite of arrow F7 may be applied to the coupling member 210 by grasping the coupling member 210 and pulling the coupling member away from the spherical portion 494.

FIGS. 19C through 21 illustrate a base member according to another embodiment of the invention. The base member 450 includes a support portion 452 and an extension member 474 that extends from the support portion 452. The extension member 474 has a cylindrical portion 476 and a spherical portion 478.

Figure 20:
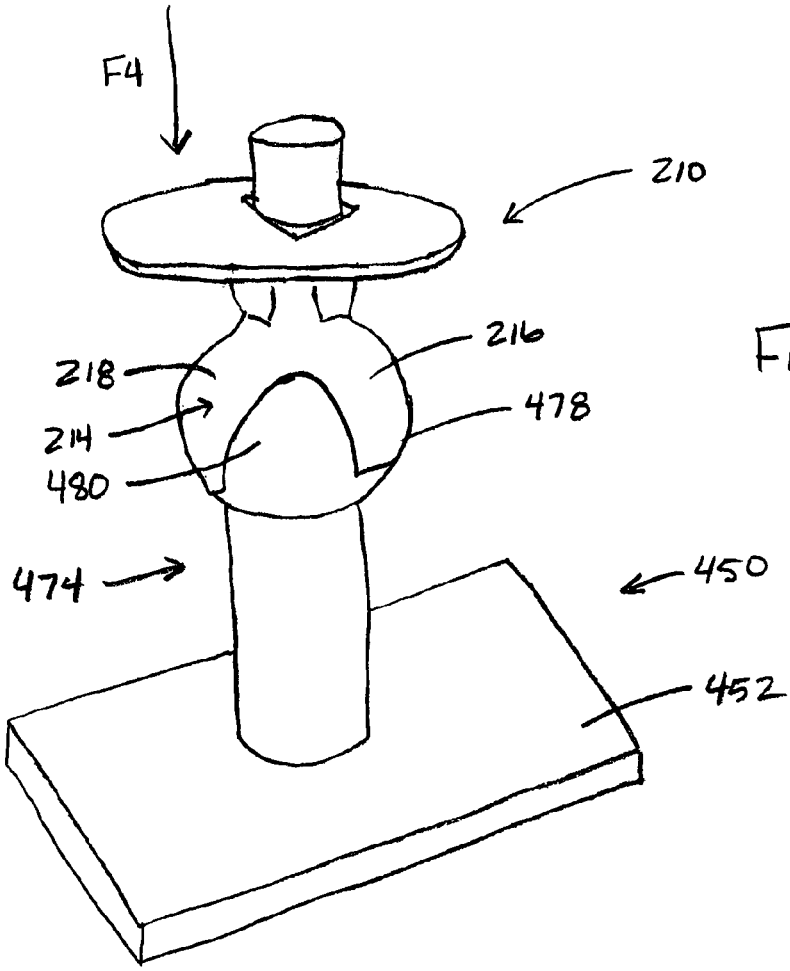
FIG. 20 is a perspective view of the coupling member of FIG. 2 coupled to the base member of FIG. 19C in a first configuration.

As illustrated in FIG. 20, the coupling member 210 may be removably coupled to the spherical portion 478 of the extension member 474. Specifically, the receiving portion 214 of the coupling member 210 receives a portion of the spherical portion 478 of the extension member 474. The projections 216, 218, and 220 of the coupling member 210 engage an outer surface 480 of the spherical portion 478 and frictionally couple the coupling member 210 to the spherical portion 478. In the illustrated embodiment, the inner surface 222 of the coupling member 210 frictionally grips the outer surface 480 of the spherical portion. In other words, the radius of curvature of the inner surface 222 of the coupling member 210 is substantially the same as the radius of curvature of the outer surface 480 of the spherical portion. In another embodiment, the projections extend around a substantial portion of the spherical portion of the extension member to capture or otherwise retain the spherical portion within the receiving portion of the coupling member. In such an embodiment, the radius of curvature of the receiving portion is larger than the radius of curvature of the outer surface of the spherical portion of the extension member.

Similar to the above embodiments, a force is applied to at least one of the coupling member 210 and the spherical portion 478 of the extension member 474 to removably couple the coupling member 210 to the spherical portion 478. For example, a force in the direction of arrow F4 may be applied to the coupling member 210 by grasping the coupling member 210 and pressing the coupling member 210 against the spherical portion 478. Such force causes the projections 216, 218, and 220 to bend or flex to fit over and grip the outer surface 480 of the spherical portion 478 to frictionally couple the coupling member 210 to the base member 450. Although the coupling member 210 is illustrated as being coupled to the spherical member 478 in one orientation, the coupling member 210 may be coupled to the spherical member 478 in any orientation. For example, the coupling member 210 may be coupled to the spherical member 478 such that the coupling member 210 extends substantially perpendicular to the base member 450. Alternatively, the coupling member 210 may be coupled to the spherical member 478 such that the coupling member extends substantially parallel to the base member 450.

To remove the coupling member 210 from the spherical portion 478, a force is applied to at least one of the coupling member 210 and the spherical portion 478. For example, a force in the opposite direction of arrow F4 may be applied to the coupling member 210 by grasping the coupling member 210 and pulling the coupling member away from the spherical portion 478.

Figure 21:
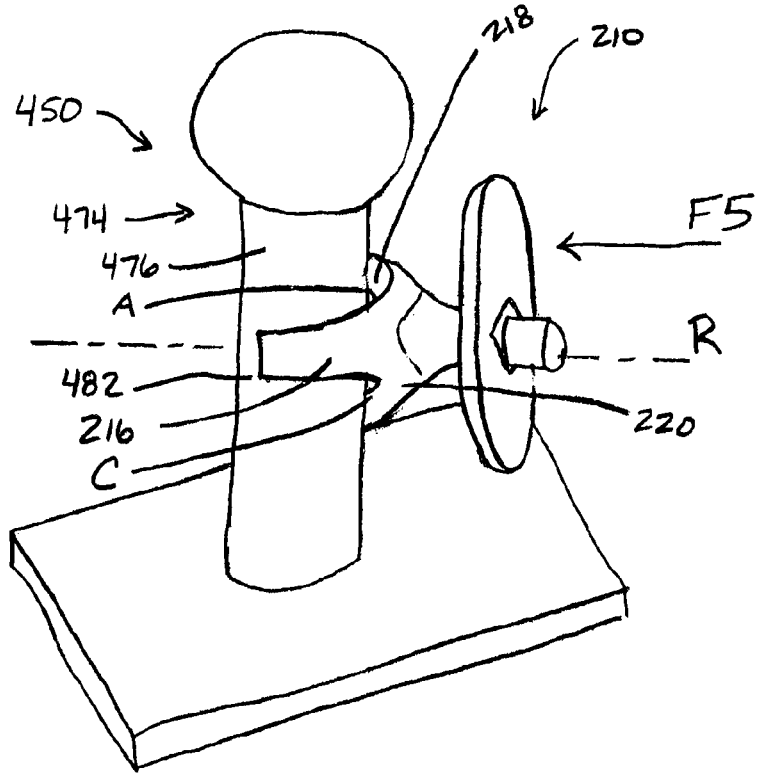
FIG. 21 is a perspective view of the coupling member of FIG. 2 coupled to the base member of FIG. 19C in a second configuration.

As illustrated in FIG. 21, the coupling member 210 may be removably coupled to the cylindrical portion 476 of the extension member 474. Specifically, the receiving portion 214 of the coupling member 210 receives a portion of a side wall 482 of the cylindrical portion 478. The projections 216, 218, and 220 of the coupling member 210 engage the side wall 482 of the cylindrical portion 476 and frictionally couple the coupling member 210 to the cylindrical portion 476.

In the illustrated embodiment, when the coupling member 210 is coupled to the cylindrical portion 476 of the base member 450, the cylindrical portion 476 extends through openings A and C of coupling member 210. Specifically, the cylindrical portion 476 is frictionally gripped or otherwise retained between an inner surface of projection 216 and edges of projection members 218 and 220. In another embodiment, the cylindrical portion 476 is frictionally gripped between an inner surface of projection 216 and an edge of one of projections 218 and 220.

Although the coupling member 210 is illustrated as being coupled to the cylindrical portion 476 in a particular orientation, the coupling member 210 may be rotated 120 or 240 degrees with respect to the cylindrical portion 476 about axis R prior to coupling the coupling member 210 to the cylindrical portion 476. Accordingly, the cylindrical portion 476 may extend through any two of the openings A, B, and C of the coupling member 210. Moreover, once coupled to the cylindrical portion 476, the coupling member 210 can be rotated through 360 degrees with respect to the cylindrical member 476.

To couple the coupling member 210 to the cylindrical portion 476 of the base member 450, the coupling member is aligned with the base member 210 such that two of the openings A, B, and C of the coupling member 210 are aligned with the cylindrical portion 476. A force is then applied to at least one of the coupling member 210 and the cylindrical portion 476 of the extension member 474 to removably couple the coupling member 210 to the cylindrical portion 476. For example, a force in the direction of arrow F5 may be applied to the coupling member 210 by grasping the coupling member 210 and pressing the coupling member 210 against the cylindrical portion 476.

To remove the coupling member 210 from the cylindrical portion 476, a force is applied to at least one of the coupling member 210 and the cylindrical portion 476. For example, a force in the opposite direction of arrow F5 may be applied to the coupling member 210 by grasping the coupling member 210 and pulling the coupling member away from the cylindrical portion 476.

FIGS. 22 and 23 illustrate another embodiment of the base member. The base member 550 includes a support portion 552 and a wall portion 584 that extends upwardly from the support portion 552. As illustrated in FIG. 23, the receiving portion 214 of the coupling member 210 is configured to receive a portion of the wall portion 584 to removably couple the coupling member 210 to the base member 550. Specifically, the projections 216, 218, and 220 of the coupling member 210 engage the wall portion 584 and frictionally couple the coupling member 210 to the wall portion 584. Although the wall portion 584 is illustrated as being disposed about the perimeter of the base member 550, the wall portion 584 need not be disposed in such a manner. For example, the wall portion may be disposed along a middle portion of the base member.

In the illustrated embodiment, the wall portion 584 extends through openings A and C of coupling member 210. Specifically, the wall portion 584 is frictionally gripped or otherwise retained between an inner surface of projection 216 and edges of projection members 218 and 220. In another embodiment, the wall portion 584 is frictionally gripped between an inner surface of projection 216 and an edge of one of projections 218 and 220.

Although the coupling member 210 is illustrated as being coupled to the wall portion 584, the coupling member 210 may be rotated 120 or 240 degrees with respect to the wall portion 584 about axis S prior to coupling the coupling member 210 to the wall portion 584. Accordingly, the wall portion 584 may extend through any two of the openings A, B, and C of the coupling member 210. Additionally, although the coupling member 210 is illustrated as being coupled to a particular portion of the wall portion 584, the coupling member 210 need not be coupled to such portion of the wall portion 584. Specifically, the coupling member 210 may be coupled to any portion of the wall portion 584.

To couple the coupling member 210 to the wall portion 584 of the base member 550, the coupling member 210 is aligned with the base member 550 such that two of the openings A, B, and C of the coupling member 210 are aligned with the wall portion 584. A force is then applied to at least one of the coupling member 210 and the wall portion 584 to frictionally couple the coupling member 210 to the wall portion 584. For example, a force in the direction of arrow F6 may be applied to the coupling member 210 by grasping the coupling member 210 and pressing or otherwise forcing the coupling member 210 against the wall portion 584.

To remove the coupling member 210 from the wall portion 584, a force is applied to at least one of the coupling member 210 and the wall portion 584. For example, a force in the opposite direction of arrow F6 may be applied to the coupling member 210 by grasping the coupling member 210 and pulling the coupling member away from the wall portion 584.

Figure 24:
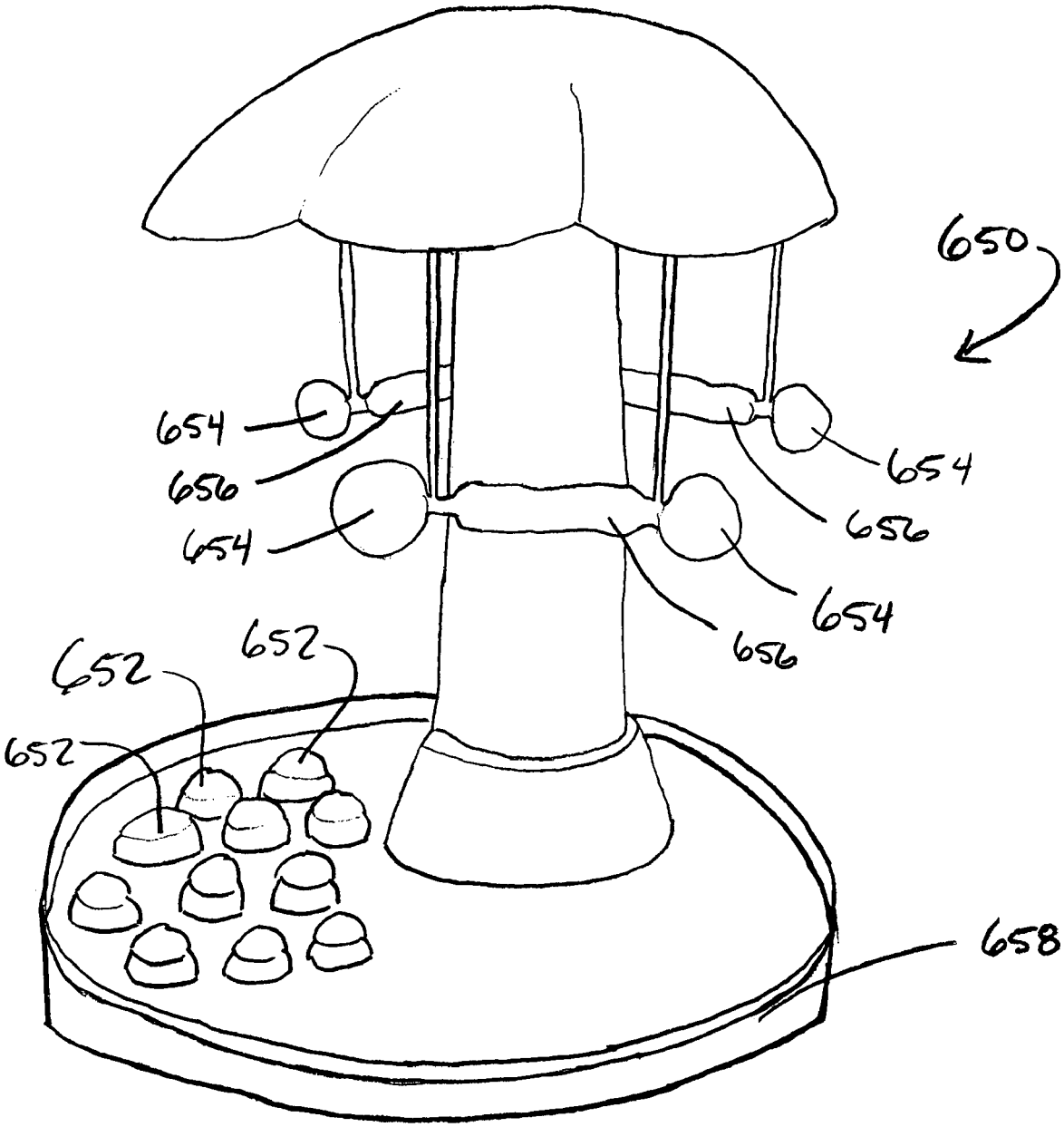
FIG. 24 is a perspective view of a base member in accordance with another embodiment of the invention.
Figure 25:
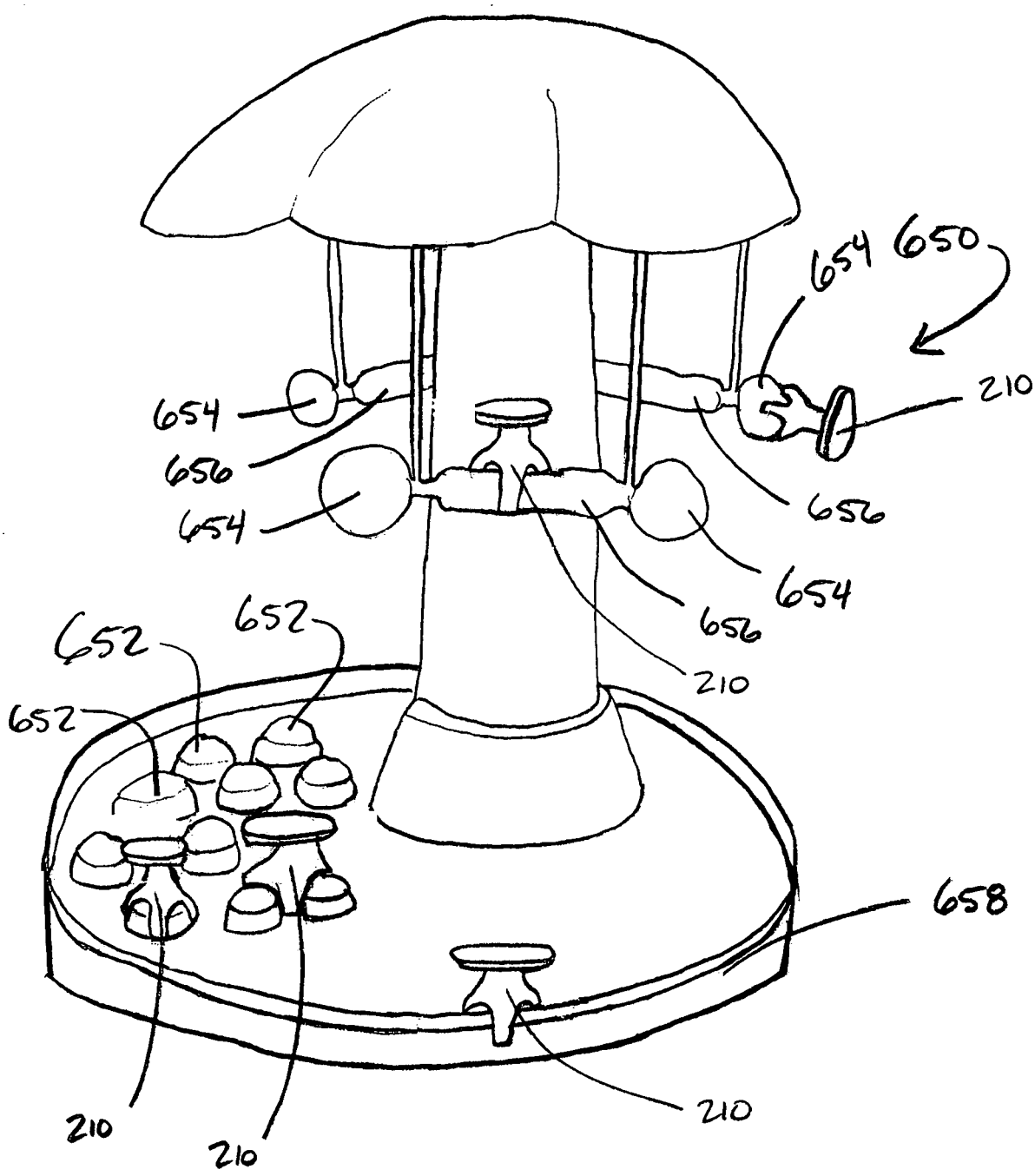
FIG. 25 is a perspective view of several coupling members of FIG. 2 coupled to the base member of FIG. 24.

FIG. 24 illustrates another embodiment of the base member. Base member 650 includes several attachment posts 652, several spherical portions 654, several cylindrical portions 656, and a wall portion 658. As illustrated in FIG. 25, using the methods described in detail above, a coupling member 210 may be removably coupled to any one of the attachment posts 652, among any set of three mutually adjacent attachment posts 652, to any of the spherical portions 654, to any of the cylindrical portions 656, and to any portion of the wall portion 658.

Figure 26:
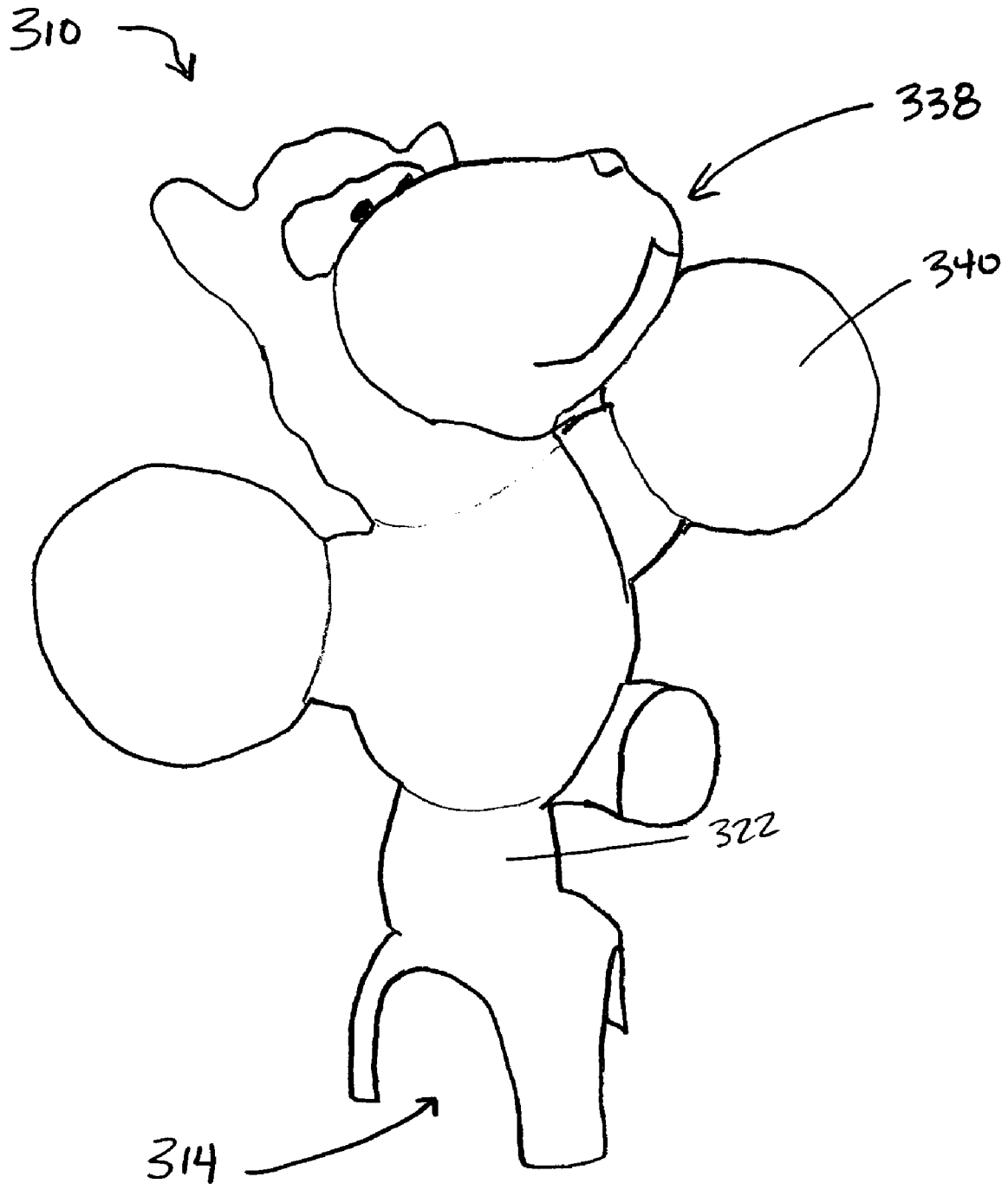
FIGS. 26 through 28 are perspective views of coupling members in accordance with other embodiments of the invention.

FIG. 26 illustrates another embodiment of the coupling member. The coupling member 310 includes a receiving portion 314, a body portion 322, and a figure portion 338 that is coupled to and extends from the body portion 322. In the illustrated embodiment, the figure portion 338 is configured to resemble an animal figure. In other embodiments, the figure portion 338 is configured to resemble other types of figures, such as human figures. In yet another embodiment, the coupling member does not include a body portion. Rather, the coupling member is a figure portion that is coupled to a receiving portion.

The coupling member 310 also includes a spherical portion 340. The spherical portion 340 is sized such that a receiving portion of another coupling member may receive a portion of the spherical portion 340. Thus, as described in detail above, the spherical portion 340 serves as a base member and another coupling member may be removably coupled to the spherical portion 340 of the coupling member 310.

Figure 27:
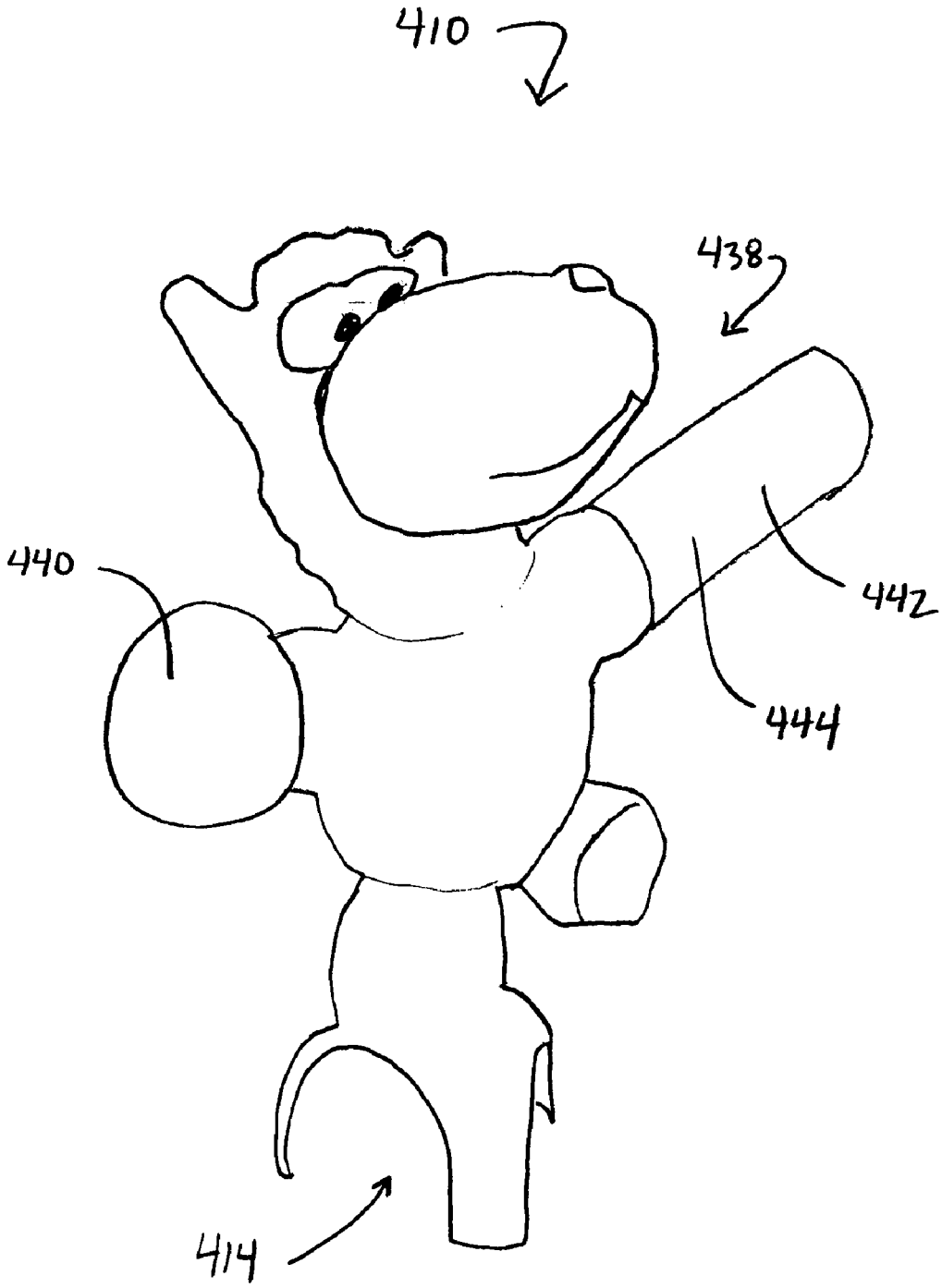

FIG. 27 illustrates another embodiment of the coupling member. The coupling member 410 includes a receiving portion 414, a figure portion 438, a spherical portion 440, and a cylindrical portion 442. The spherical portion 440 is sized such that a receiving portion of another coupling member may receive a portion of the spherical portion 440. Thus, as described in detail above, another coupling member may be removably coupled to the spherical portion 440 of the coupling member 410. The cylindrical portion 442 of the coupling member 410 is sized such that a receiving portion of another coupling member may receive a portion of the side wall 444 of the cylindrical portion 442. Thus, as described in detail above, another coupling member (210, 310, 410) may be removably coupled to the cylindrical portion 442 of the coupling member 410.

Figure 28:
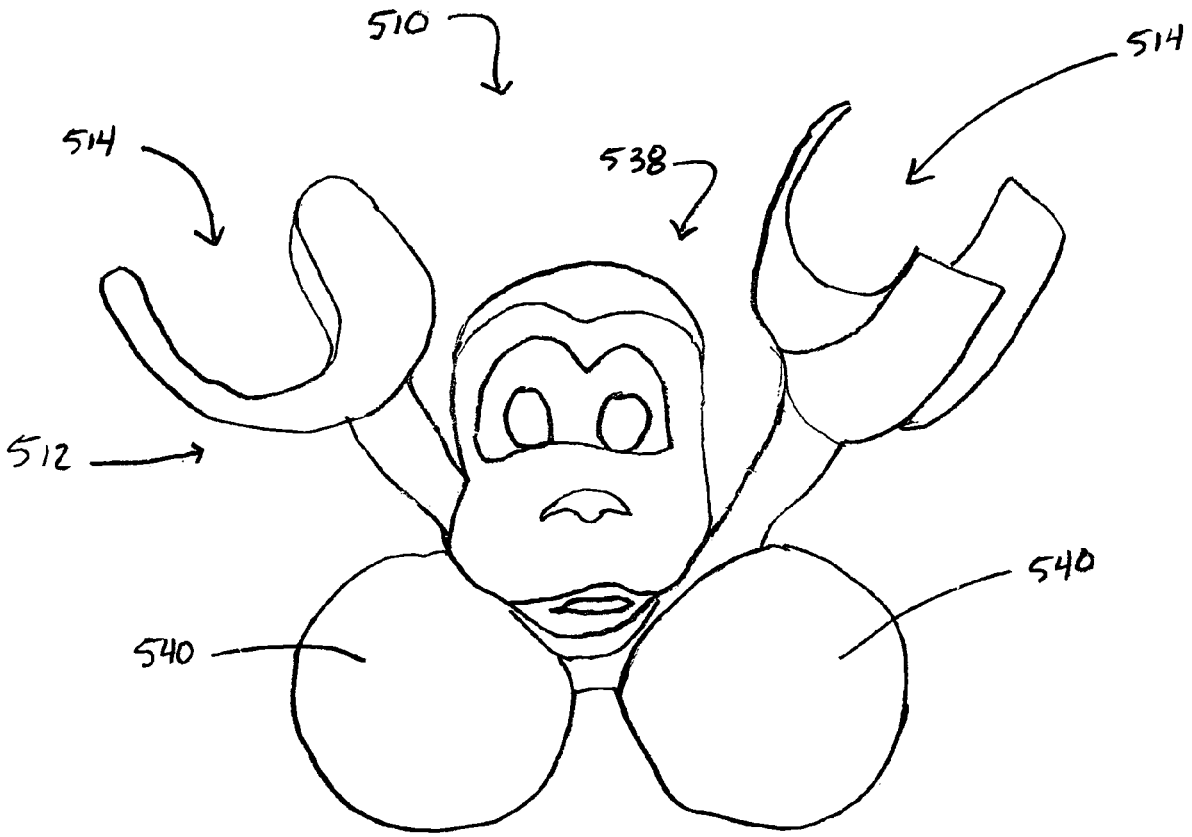

FIG. 28 illustrates another embodiment of the coupling member. The coupling member 510 includes two receiving portions 514, a figure portion 538, and two spherical portions 540. The receiving portions 514 of the coupling member 510 are disposed at an upper portion 512 of the coupling member 510. The spherical portions 540 are sized such that a receiving portion of another coupling member may receive a portion of the spherical portions 540. Thus, as described in detail above, another coupling member 510 may be removably coupled to the spherical portions 540 of the coupling member 510.

Figure 29:
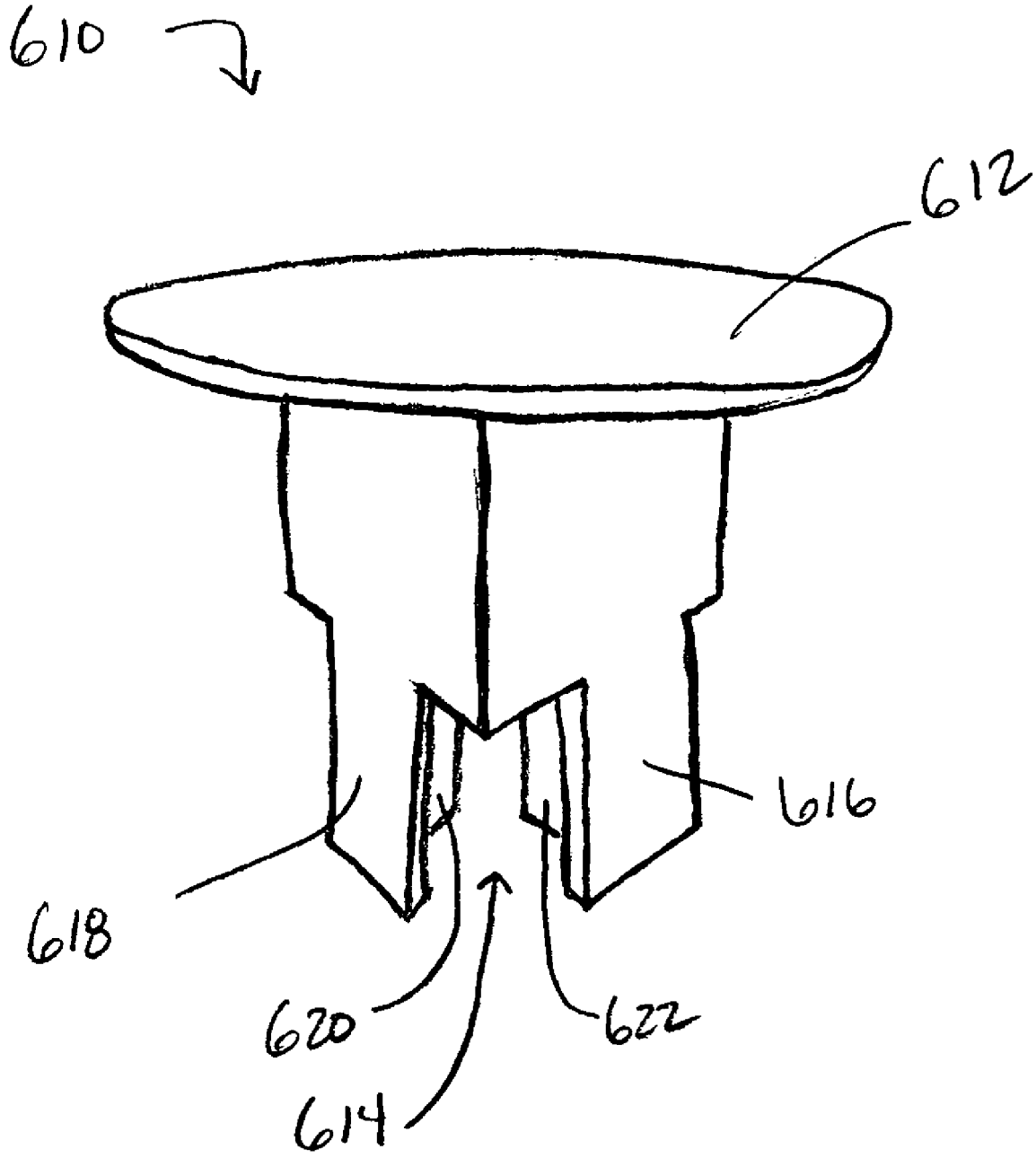
FIG. 29 is a perspective view of a coupling member in accordance with another embodiment of the invention.

FIGS. 29 and 30 illustrate a coupling member in accordance with another embodiment of the invention. The coupling member 610 includes a body portion 612 and four projections 616, 618, 620, and 622 that extend downwardly from the body portion 612. The four projections define a receiving portion 614.

FIG. 31 illustrates a base member accordance with another embodiment of the invention. The base member 750 includes a support portion 752 and a set of four mutually adjacent attachment posts 754, 756, 758, and 760. The attachment posts are cubical in shape.

As illustrated in FIG. 32, the coupling member 610 may be removably coupled to attachment post 760 of the base member 750. Specifically, the receiving portion 614 of the coupling member 610 receives at least a portion of the attachment post 760. Although the coupling member 610 is illustrated as being coupled to attachment post 760, the coupling member may be coupled to any one of the attachment posts 754, 756, and 758. Additionally, although the coupling member 610 is illustrated as being removably coupled to the attachment post 760 in a particular orientation, the coupling member 610 may be rotated 90, 180, or 270 degrees with respect to the base member 750 prior to coupling the coupling member 610 to the attachment post 760.

As illustrated in FIG. 33, the coupling member 610 may be removably coupled among the attachment posts 754, 756, 758, and 760 of the base member 750. Each of the projections 616, 618, 620, and 622 is disposed between two of the attachment posts 754, 756, 758, and 760. Specifically, projection 616 is disposed and frictionally coupled between attachment posts 758 and 760; projection 618 is disposed and frictionally coupled between attachment posts 760 and 754; projection 620 (not illustrated in FIG. 33) is disposed and frictionally coupled between attachment posts 754 (not illustrated in FIG. 33) and 756 (not illustrated in FIG. 33);

and projection 622 is disposed and frictionally coupled between attachment posts 756 (not illustrated in FIG. 33) and 758. Although the coupling member 610 is illustrated as being removably coupled among the attachment posts 754, 756, 758, and 760 in a particular orientation, the coupling member 610 may be rotated 90, 180, or 270 degrees with respect to the base member 750 prior to coupling the coupling member 610 to the base member 750.

Although the attachment posts of the base member have been illustrated and described as having certain geometric shapes, the base member may include attachment posts of any geometric shape. Additionally, the attachments posts may be arranged on the base member in any repeating pattern.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. For example, the coupling members and the base member may include any combination of connection devices. Additionally, any type of coupling member may used with any of the base members described herein.

What is claimed is:

1. A toy, comprising:

a base member having a first attachment post, a second attachment post, a third attachment post, wall portion, a spherical portion, and a cylindrical portion; and a coupling member having a receiving portion, the receiving portion being configured to receive at least a portion of the first attachment post of the base member to removably couple the coupling member to the base member, the receiving portion being configured to extend between and engage each of the first attachment post, the second attachment post, and the third attachment post to removably couple the coupling member to the base member, the receiving portion being configured to receive at least a portion of the wall portion to removably couple the coupling member to the base member, the receiving portion being configured to receive at least a portion of the spherical portion to removably couple the coupling member to the base member, the receiving portion being configured to receive at least a portion of the cylindrical portion to removably couple the coupling member to the base member.

2. The toy of claim 1, wherein the coupling member includes a figure portion.

3. The toy of claim 1, wherein the coupling member includes an animal figure portion.

4. The toy of claim 1, wherein the coupling member has a first projection, a second projection, and a third projection that collectively define the receiving portion.

5. The toy of claim 1, wherein the first attachment post is disposed a distance from the second attachment post, the first attachment post of the base member is disposed the distance from the third attachment post, and the second attachment post is disposed the distance from the third attachment post.

6. The toy of claim 1, wherein the first attachment post has a slot defined therein, the slot of the first attachment post of the base member being configured to receive at least a portion of the coupling member when the receiving portion of the coupling member is extended between and engaged with each of the of the first attachment post, the second attachment post, and the third attachment post to removably couple the coupling member to the base member.

7. The toy of claim 1, wherein the receiving portion encloses the top portion of the first attachment post when receiving portion receives at least a portion of the first attachment post to removably couple the coupling member to the base member.

* * * * *